US007954504B2

(12) United States Patent
Price et al.

(10) Patent No.: US 7,954,504 B2
(45) Date of Patent: Jun. 7, 2011

(54) FAST-ERECTING PORTABLE STRUCTURE

(76) Inventors: R. Justin Price, Mesa, AZ (US); Walter L. Price, Mesa, AZ (US)

( * ) Notice: Subject to any disclaimer, the term of this patent is extended or adjusted under 35 U.S.C. 154(b) by 990 days.

(21) Appl. No.: 10/596,865

(22) PCT Filed: Dec. 30, 2004

(86) PCT No.: PCT/US2004/043986
§ 371 (c)(1),
(2), (4) Date: Jun. 27, 2006

(87) PCT Pub. No.: WO2005/067510
PCT Pub. Date: Jul. 28, 2005

(65) Prior Publication Data

US 2007/0137683 A1 Jun. 21, 2007

Related U.S. Application Data

(60) Provisional application No. 60/534,308, filed on Jan. 5, 2004.

(51) Int. Cl.
*E04H 15/40* (2006.01)
*A45F 4/04* (2006.01)

(52) U.S. Cl. ..... 135/156; 135/126; 135/137; 135/119; 135/905; 224/153; 190/107; 383/4

(58) Field of Classification Search ..... 135/124, 135/125–26, 128, 136, 137, 156, 115, 119, 135/905–906; 224/153, 159–160; 190/107, 190/110; 383/4, 6, 31, 37, 40, 84, 87
See application file for complete search history.

(56) References Cited

U.S. PATENT DOCUMENTS

| | | | | |
|---|---|---|---|---|
| 2,247,320 | A * | 6/1941 | Stanley | 150/119 |
| 2,266,853 | A | 12/1941 | Dabney | |
| 2,481,565 | A * | 9/1949 | Boretz | 190/109 |
| 2,490,222 | A * | 12/1949 | Lowe | 190/119 |
| 2,547,770 | A | 4/1951 | Pelton | |
| 3,190,300 | A | 6/1965 | Wear'n | |
| 3,621,857 | A | 11/1971 | May et al. | |
| 3,800,814 | A | 4/1974 | Hibbert | |
| 3,925,943 | A | 12/1975 | Petrie | |
| 3,960,161 | A | 6/1976 | Norman | |

(Continued)

FOREIGN PATENT DOCUMENTS

| | | |
|---|---|---|
| EP | 545637 | 6/1993 |

(Continued)

*Primary Examiner* — Winnie Yip
(74) *Attorney, Agent, or Firm* — Venable, Campillo, Logan & Meaney P.C.

(57) ABSTRACT

In its preferred embodiment, the fast-erecting portable structure principally comprises two or more flexible framing rods and a flexible skin. The flexible framing rods essentially form inverted u-shapes and the flexible skin hangs from the flexible framing rods in substantially a dome shape. More specifically, the flexible skin can be supported from the flexible framing rods by sleeves sewn into the flexible skin. The sleeves allow the flexible skin to slide along the length of the flexible framing rods. The flexible skin is also fixed (or non-removably) connected to the ends of the flexible framing rods. The fast-erecting portable structure can be stored by coiling the flexible framing rods into a storage bag. The fast-erecting portable structure allows the structure to be immediately erected from the coiled position in the storage bag into the structure without any intermediate steps or the addition or removal of any parts.

29 Claims, 26 Drawing Sheets

U.S. PATENT DOCUMENTS

| | | | | | |
|---|---|---|---|---|---|
| 3,970,096 | A | | 7/1976 | Nicolai | |
| 3,990,463 | A | | 11/1976 | Norman | |
| 4,085,873 | A | | 4/1978 | Schweitzer | |
| 4,182,391 | A | * | 1/1980 | Kjose | 224/581 |
| 4,192,333 | A | * | 3/1980 | Sato | 135/124 |
| 4,195,651 | A | * | 4/1980 | Watts et al. | 135/135 |
| 4,311,159 | A | | 1/1982 | Wunderlich | |
| 4,520,835 | A | | 6/1985 | Moeller | |
| 4,665,935 | A | * | 5/1987 | Nichols | 135/125 |
| 4,709,718 | A | | 12/1987 | Nichols | |
| 4,858,634 | A | | 8/1989 | McLeese | |
| 4,858,635 | A | | 8/1989 | Eppenbach | |
| 5,067,505 | A | * | 11/1991 | Cantwell et al. | 135/125 |
| 5,137,044 | A | * | 8/1992 | Brady | 135/126 |
| 5,163,461 | A | | 11/1992 | Ivanovich et al. | |
| 5,197,504 | A | * | 3/1993 | Howe | 135/127 |
| 5,337,772 | A | | 8/1994 | Habachi | |
| 5,370,145 | A | * | 12/1994 | Wu | 135/127 |
| 5,404,896 | A | * | 4/1995 | Howe | 135/125 |
| 5,407,291 | A | | 4/1995 | Hazinski et al. | |
| 5,601,105 | A | | 2/1997 | Blen et al. | |
| 5,628,336 | A | | 5/1997 | Lee | |
| 5,638,850 | A | | 6/1997 | Hazinski et al. | |
| 5,645,096 | A | | 7/1997 | Hazinski et al. | |
| 5,676,168 | A | | 10/1997 | Price | |
| 5,901,727 | A | | 5/1999 | Kramer et al. | |
| 5,937,883 | A | * | 8/1999 | Camara | 135/87 |
| 6,199,229 | B1 | | 3/2001 | Wong | |
| 6,325,086 | B1 | | 12/2001 | Shinner et al. | |
| 6,328,050 | B1 | * | 12/2001 | McConnell | 135/137 |
| 6,371,143 | B1 | | 4/2002 | Swetish | |
| 6,382,376 | B1 | * | 5/2002 | Rosen et al. | 190/108 |
| 6,397,869 | B1 | | 6/2002 | Jennings | |
| 6,470,901 | B1 | | 10/2002 | Scherer | |
| 6,514,149 | B2 | | 2/2003 | Yoon | |
| 6,517,444 | B1 | | 2/2003 | Yoon | |
| D482,522 | S | * | 11/2003 | Hassett | D3/218 |
| 6,655,565 | B2 | * | 12/2003 | Godshaw et al. | 224/653 |
| 6,772,883 | B2 | * | 8/2004 | Lindamood | 206/320 |
| 7,025,073 | B2 | * | 4/2006 | Holub | 135/119 |
| 7,040,333 | B1 | * | 5/2006 | Ransom et al. | 135/126 |
| 7,111,714 | B1 | * | 9/2006 | Bell, III | 190/118 |
| 2006/0185707 | A1 | * | 8/2006 | Viglione | 135/126 |

FOREIGN PATENT DOCUMENTS

| | | |
|---|---|---|
| WO | WO 96/18789 | 6/1996 |

* cited by examiner

FAST-ERECTING PORTABLE STRUCTURE

CROSS-REFERENCE TO RELATED APPLICATIONS

The present application claims priority to co-pending U.S. provisional application entitled "Fast-Erecting Portable Structure," having Ser. No. 60/534,308, filed by inventors R. Justin Price and Walter L. Price on Jan. 5, 2004, which is entirely incorporated herein by reference.

BACKGROUND OF THE INVENTION

1. Field of the Invention

The present invention relates generally to portable fast-erecting structures, and particularly to portable fast-erecting tents.

2. Discussion of the Related Art

Prior apparatus designed to achieve a portable structure that can be quickly erected have been disclosed in the following United States or foreign patents: U.S. Pat. No. 3,960,161 (Norman), U.S. Pat. No. 3,990,463 (Norman), U.S. Pat. No. 4,858,634 (McLeese), U.S. Pat. No. 5,163,461 (Ivanovich et al.), U.S. Pat. No. 5,407,291 (Hazinski et al.), U.S. Pat. No. 5,676,168 (Price), U.S. Pat. No. 5,337,772 (Habachi), U.S. Pat. No. 5,601,105 (Blen et al.), U.S. Pat. No. 5,645,096 (Hazinski et al.), U.S. Pat. No. 6,199,229 (Wong), U.S. Pat. No. 6,514,149 (Yoon), U.S. Pat. No. 6,517,444 (Yoon), U.S. Pat. No. 6,371,143 (Swetish), U.S. Pat. No. 6,325,086 (Shinner et al.), U.S. Pat. No. 5,370,145 (Wu), U.S. Pat. No. 4,520,835 (Moeller), U.S. Pat. No. 4,311,159 (Wunderlich), U.S. Pat. No. 3,925,943 (Petrie), U.S. Pat. No. 3,190,300 (Wear'n), U.S. Pat. No. 2,547,770 (Pelton), U.S. Pat. No. 2,266,853 (Dabney), U.S. Pat. No. 3,970,096 (Nicolai), U.S. Pat. No. 5,638,850 (Hazinski et al.), U.S. Pat. No. 3,800,814 (Hibbert), U.S. Pat. No. 3,621,857 (May, et al.), U.S. Pat. No. 4,709,718 (Nichols), U.S. Pat. No. 4,858,635 (Eppenbach), U.S. Pat. No. 6,470,901 B1 (Scherer), U.S. Pat. No. 6,397,869 (Jennings), and EPO application 545,637 (Gartin et al.). None of these references, however, disclose the aspects of the current invention.

SUMMARY OF THE INVENTION

The invention is summarized below only for purposes of introducing embodiments of the invention. The ultimate scope of the invention is to be limited only to the claims that follow the specification.

In the preferred embodiment shown in FIG. 1, the fast-erecting portable structure principally comprises two flexible framing rods and a flexible skin. In the open or "released" position, the flexible framing rods form two inverted u-shapes that are roughly perpendicular to each other. The flexible skin hangs from the flexible framing rods in substantially a dome shape. More specifically, the flexible skin is supported from the flexible framing rods by sleeves sewn into the flexible skin. The sleeves allow the flexible skin to slide along the length of the flexible framing rods. The flexible skin is also fixed (or non-removably connected) to the ends of the flexible framing rods.

The fast-erecting portable structure can be stored by coiling the flexible framing rods into a storage bag. It is preferred that the storage bag has an interior pocket. The interior pocket is valuable for assistance in coiling the flexible framing rods into the storage bag. FIGS. 5A-5R illustrate the preferred method of coiling and stowing the fast-erecting portable structure: first, rotate the first framing rod relative to the second framing rod so that they are roughly parallel to each other, second, insert one end of the first framing rod and one end of the second framing rod into the interior pocket; third, coil the first framing rod and the second framing rod into the storage bag by working from the ends of the framing rods and tucking the framing rod into the storage bag at approximately one foot of flexible framing rod at a time until the entire length of framing rods are coiled inside the storage bag; fourth, stuff the flexible skin into the storage bag and fifth, close the storage bag.

To set up the fast-erecting portable shelter once it has been coiled and stowed in the storage bag, one would simply grab the loose ends of the flexible framing rods, the ends not in the interior pocket, and begin pulling the ends out of the storage bag until the fast-erecting portable structure is completely out of the storage bag. One of the two flexible framing rods is then released (so that the user is holding only one of the two flexible framing rods). Once the user is holding only one of the two flexible framing rods, the fast-erecting portable structure will finish opening on its own. The fast-erecting portable structure can then be placed in a desired location. The four ends of the flexible framing rods rest on the surface of the desired location forming a base. The fast-erecting portable structure allows the structure to be immediately erected from the coiled position in the storage bag into the structure shown in FIG. 1A without any intermediate steps or the addition or removal of any parts. Optional embodiments include the addition of a third (or more) framing rod, a rain-fly, a rain-fly with its own flexible framing rods, stabilizing guys and stakes as described more fully herein.

It is an object of the present invention to provide a fast-erecting portable structure that requires no insertion or removal of support rods or poles to set up or take down the tent under ordinary circumstances.

Likewise, it is an object of the present invention to provide a fast-erecting portable structure that does not require the tent skin to be separated from the tent's support structure to set up or take down the tent under ordinary circumstances.

It is an object of the present invention to provide a fast-erecting portable structure that requires no framing loops It is an object of the present invention to provide a fast-erecting portable structure that does not require its framing system to undergo compound bending.

It is an object of the present invention to provide a fast-erecting portable structure that does not require tubular sleeves to reduce torsional stress.

It is an object of the present invention to provide a fast-erecting portable structure that can be quickly an easily stowed in a small and conveniently portable bag.

It is an object of the present invention to provide a fast-erecting portable structure that does not need to be folded into a "figure-eight" in order to stow it in a reasonably sized portable bag.

It is an object of the present invention to provide a fast-erecting portable structure that is a double-wall structure, the inside wall being breathable and the outside wall waterproof.

It is an object of the present invention to provide a fast-erecting portable structure that can stand alone without guy reinforcement, but have a guy reinforcement option available.

The description of the invention that follows, together with the accompanying drawings, should not be construed as limiting the invention to the example shown and described, because those skilled in the art to which this invention pertains will be able to devise other forms thereof within the ambit of the appended claims.

BRIEF DESCRIPTION OF THE DRAWINGS

FIGS. 6A and 6B illustrate the preferred embodiment of the fast-erecting portable structure.

FIG. 10 illustrates an embodiment of a non-removable connection between the flexible framing rod and flap.

FIG. 18B is a top view of the embodiment.

DESCRIPTION OF PREFERRED EMBODIMENT

Figure 1:
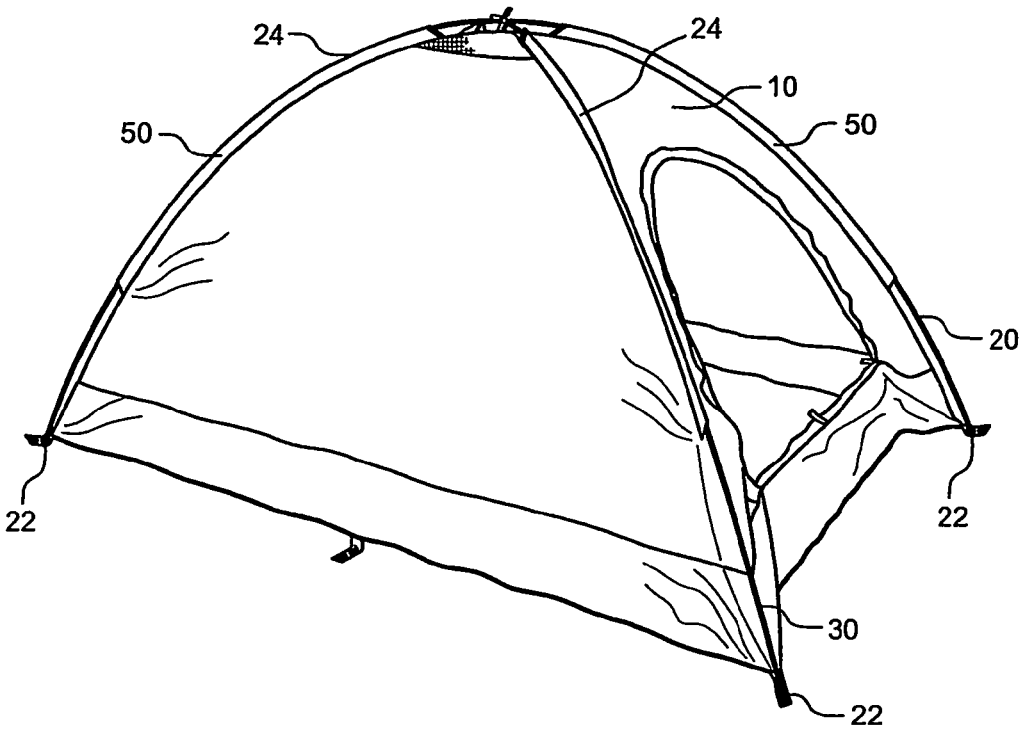
FIGS. 1 and 1A illustrate the preferred embodiment of the four-panel fast-erecting portable structure.

It is to be understood that the descriptions below are merely illustrative of the presently preferred embodiments of the invention and that no limitations are intended to the detail of construction or design herein shown other than as defined in the appended claims. In this specification, the term "non-removable" or "non-removably connected" refers to a connection that is not intended to be disconnected at any time by the user under ordinary circumstances during the useful life of the tent, including when the tent is set up, taken down, or stored away for future use. A "non-removable" connection could be removable in a non-ordinary circumstance, such as to remove and replace a broken part. In this specification, the term "slidably" or "slidably connected" refers to a connection where one part can move in relation to another part such as between a rod and a fabric sleeve when the rod is inserted into the fabric sleeve.

Generally, the invention is incorporated in a fast-erecting tent having a flexible skin 10, a first flexible framing rod 20, and a second flexible framing rod 30. The first flexible framing rod 20 and the second flexible framing rod 30 each have two ends 22 and a middle 24. As used in this patent application, the term "middle" is not synonymous with center, but refers to any area on the rod that is between the two ends 22. In the released position shown in FIG. 1, the first flexible framing rod 20 and the second flexible framing rod 30 each form substantially into an inverted u-shape. In the two-rod embodiment, the first flexible framing rod 20 forms a first plane that is roughly perpendicular to a second plane formed by the second flexible framing rod 30. In this embodiment, the second flexible framing rod 30 crosses the first flexible framing rod 20 near the apex of the inverted u-shape. The two ends 22 of the first flexible framing rod 20 and the two ends 22 of the second flexible framing rod 30 act as a base of the fast-erecting portable structure.

It is preferred that the flexible skin 10 be made, at least in part, from cotton. Other fabrics, such as polyester and nylon, will also work. Desired items such as doors, windows, screens and vents can be provided in conventional manner. In the preferred embodiment, the flexible skin 10 is created in a dome shape. It is preferred to create a dome shape by sewing together four separate panels, but many methods are known to create a flexible skin 10 in a dome shape. In the preferred embodiment, the first flexible framing rod 20 and the second flexible framing rod 30 form substantially into an inverted u-shape when the fast-erecting portable structure is released or picked up into the air by lifting up one of the flexible framing rods (20 & 30).

Figure 2:
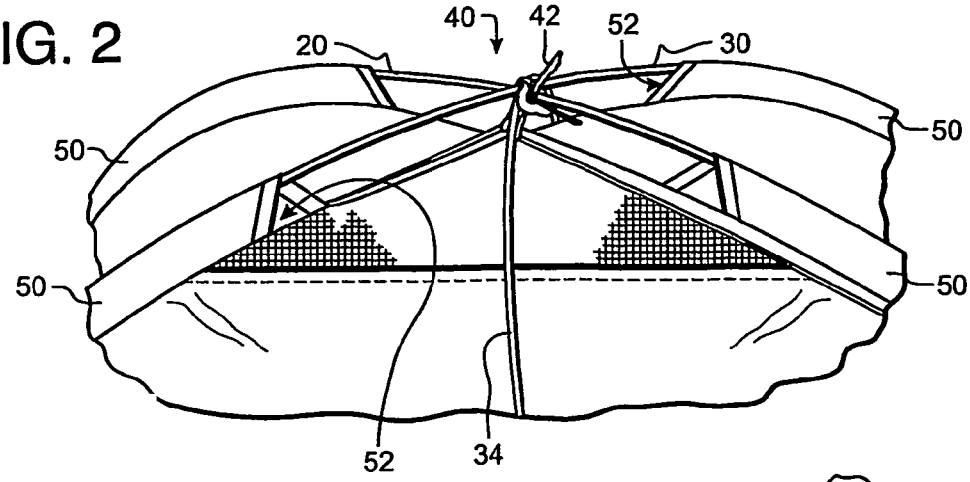
FIG. 2 is an enlarged view of a sleeve 50, the preferred flexible tie 42 connection and intersection 40.
Figure 3:
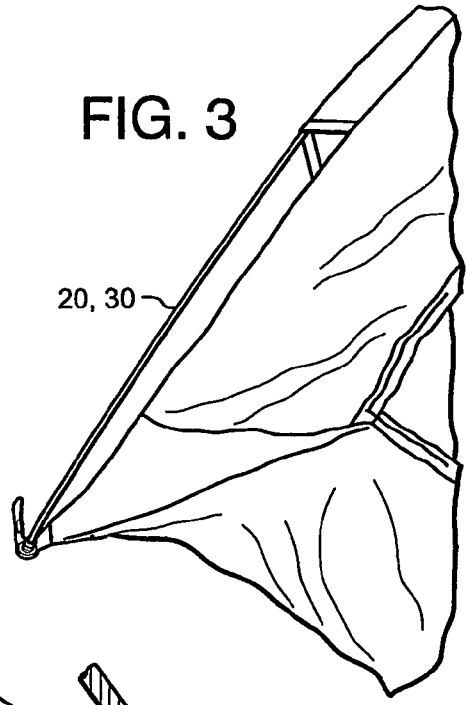
FIGS. 3, 3A and 10 illustrate an end 22 of a flexible framing rod having a grommet holding piece 16 and flexible ring 18 holding the flap 12 the grommet 14 connected to the flexible skin 10.
Figure 3A:
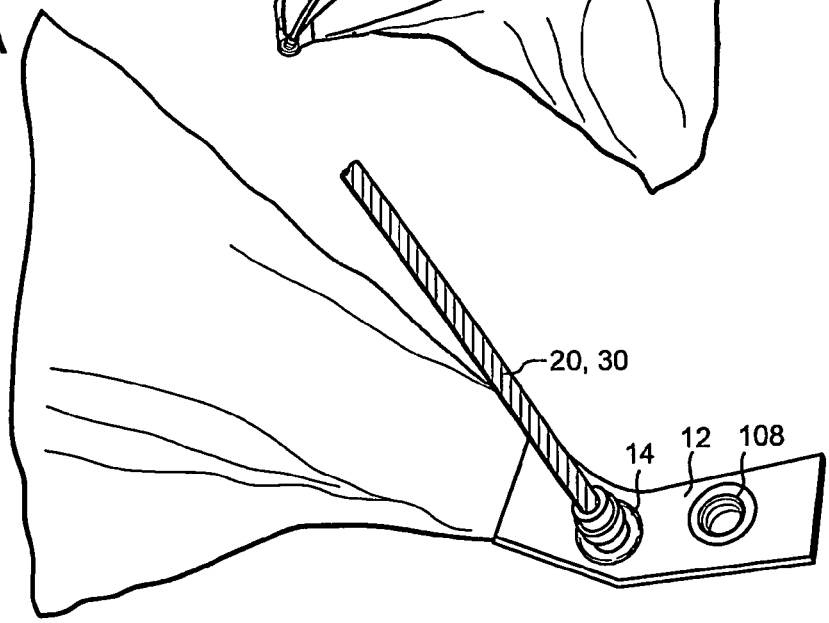

It is preferred to slidably connect the flexible skin 10 to the middle 24 of the first and second flexible framing rods (20 & 30). This can be accomplished through the use of a sleeve 50. It is preferred to use sleeves 50 made a material substantially similar to the flexible skin 10. It is also preferred to sew the sleeve 50 into the flexible skin 10. Having a sleeve 50 allows the flexible skin 10 to move or slide relative to flexible framing rods (20 & 30). Many other materials will also work as a sleeve, including a plurality of cloth loops. One or more sleeve openings 52 can be placed at desirable locations. For example, as shown in FIG. 2, it is preferred to place a sleeve opening 52 at the intersection 40 between the first and second flexible framing rods (20 & 30).

In the preferred embodiment shown in FIG. 1, the sleeves 50 are connected to the flexible skin 10 predominantly along the middle 24 of the first and second flexible framing rods (20 & 30). In an alternate embodiment, the sleeves 50 are not connected to the skin predominantly-along the middle 24 of the first and second flexible framing rods (20 & 30), but the sleeves 50 are intermittently spaced along the length of the first and second flexible framing rods (20 & 30).

Figure 10:
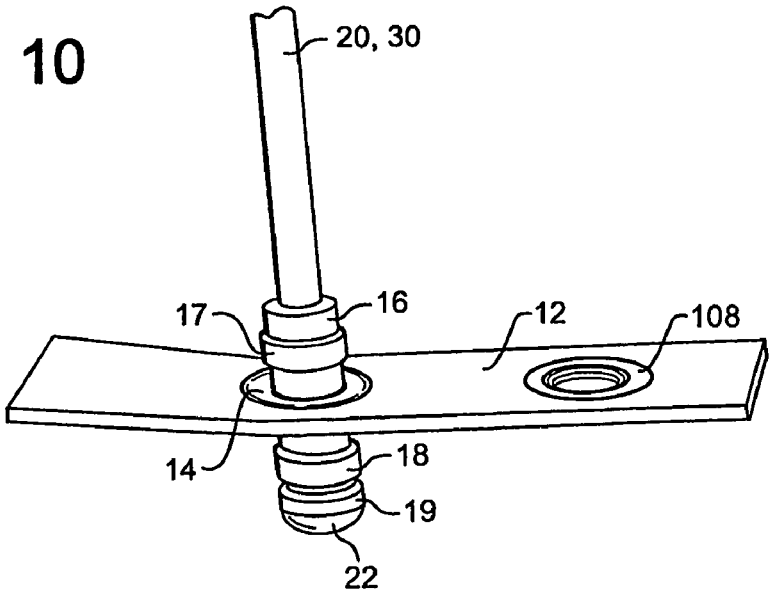
Figure 11:
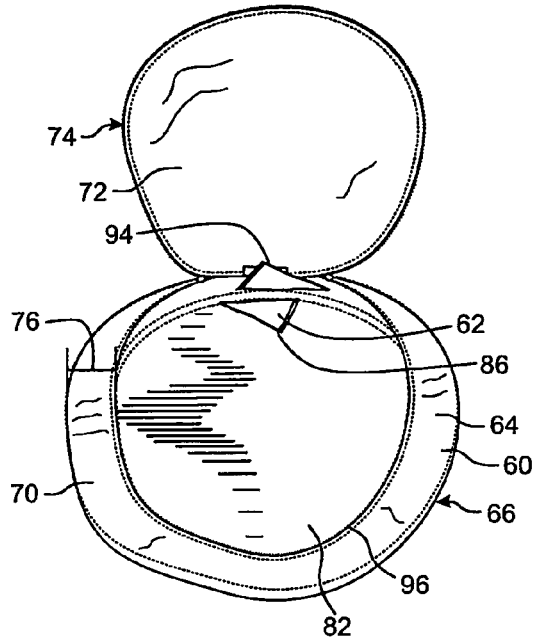
FIG. 11 illustrates a preferred embodiment of a storage bag.
Figure 12:
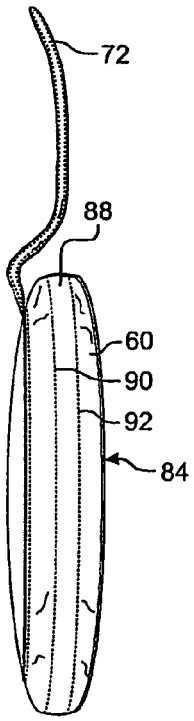
FIG. 12 illustrates a side view of a preferred embodiment of a bag with the flap open.

It is preferred to non-removably connect the flexible skin 10 to the ends 22 of the flexible framing rods (20 & 30). As shown in FIG. 10, it is preferred to sew a flap 12 having a grommet 14 onto the flexible skin 10 near the ends 22 of the flexible framing rods (20 & 30). The flap 12 can be made from most any fabric typically used in the art. There are many ways to non-removably connect the grommet 14 to the end 22. It is preferred to fabricate a cap 16 that can be glued or otherwise fastened onto the ends 22 of the flexible framing rods (20 & 30). It is preferred to fabricate the cap 16 from aluminum, but another suitable material can be used. The cap should have a flared section 17 so the grommet 14 can slide onto the cap 16 but only up to the flared section 17. The cap 16 can then be inserted through the grommet 14. After the cap 16 has been inserted through the grommet 14, a flexible ring 18 can then be inserted on the cap 16 to prevent the grommet from sliding off the cap 16 as shown in FIG. 10. The flexible ring 18 is prevented from sliding off the cap 16 by a second flared section 19. It is preferred to manufacture the flexible ring 18 from a rubber-type material so that it can slide over the second flared 19 section after the cap 16 is inserted through the grommet 14 but cannot slide back under ordinary circumstances. The flared section 17 on one side of the grommet 14 and the flexible ring 18 on the other side keeps the grommet 14 non-removably connected to the end 22.

It is preferred to use fiberglass pultrusion for the flexible framing rods 20 and 30. Other resilient material, such as spring wire, steel, plastic rod, fiberglass or structural polymer material will also work.

The flexible framing rods (20 & 30) do not need to be connected to each other. Similarly, the flexible framing rods (20 & 30) need not be prevented from moving independently from each other. It is preferred that the first and second flexible framing rods (20 & 30) move independently of each other.

It is preferred to use a flexible tie 42 to help center the flexible skin 10 below the intersection 40. It is preferred to create the flexible tie 42 from nylon or the same material used to make the flexible skin 10 however any suitable material will work. It is preferred to sew two flexible ties 42 to the center of the flexible skin 10 and tie the two flexible ties 42 together (using a bow tie or similar knot) over the intersection 40 of the flexible framing rods (20 & 30) as shown in FIG. 2.

Figure 1A:
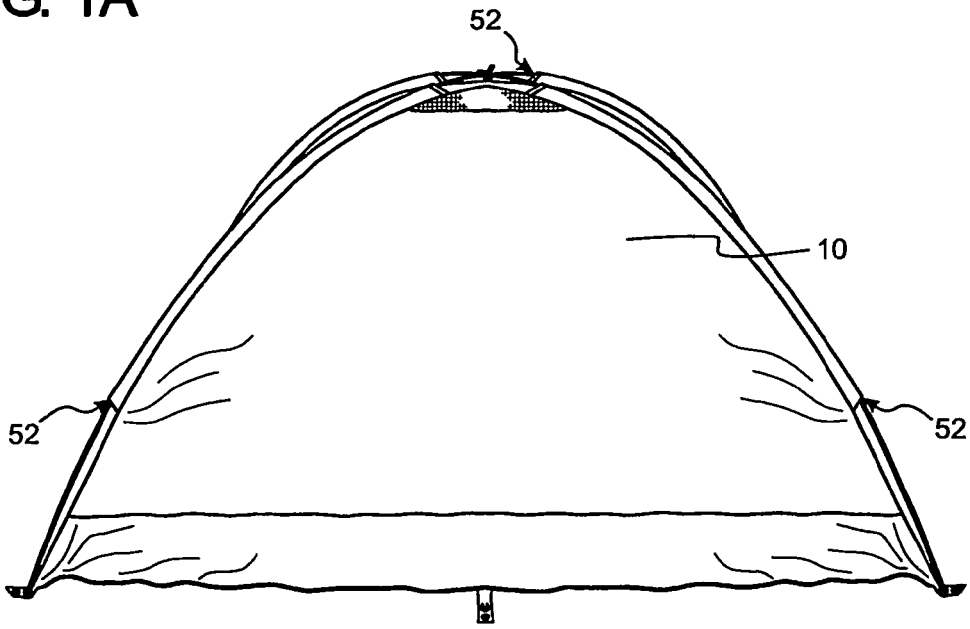
Figure 1B:
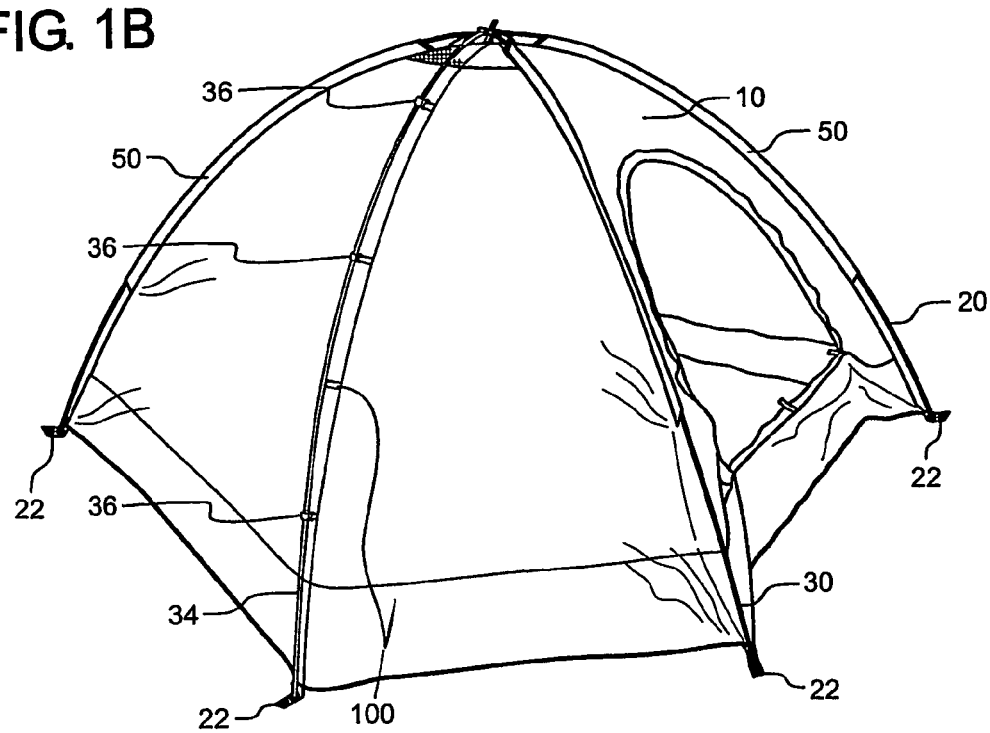
FIGS. 1B and 1C illustrate the preferred embodiment of the six-panel fast-erecting portable structure.
Figure 1C:
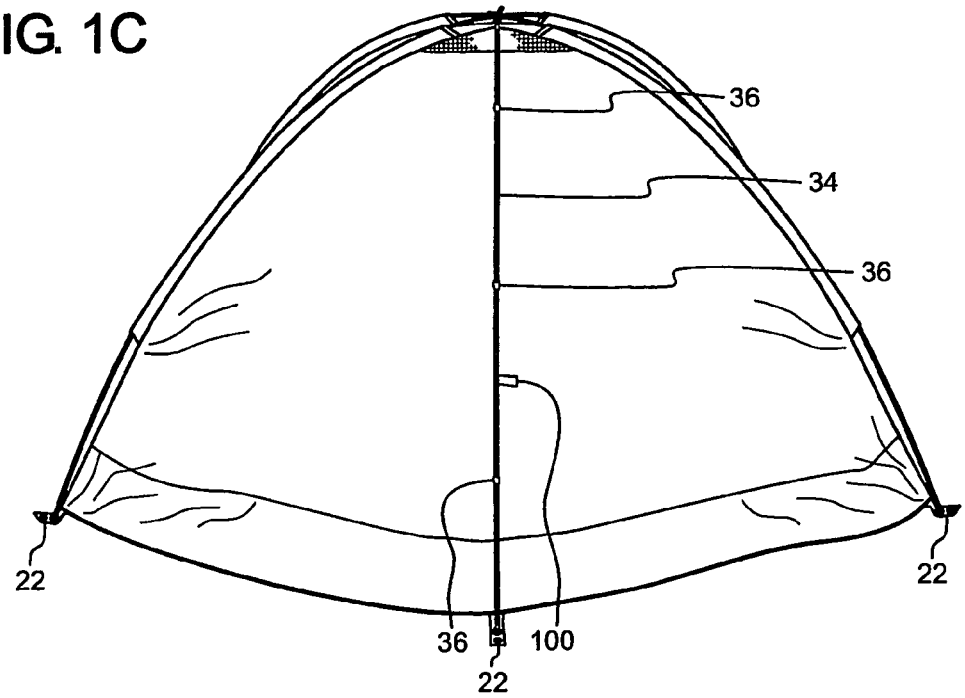

The fast-erecting portable structure can optionally include a third flexible framing rod 34 as shown in FIGS. 1C and 1D. Like the first and second flexible framing rods (20 & 30), the third flexible framing rod 34 is formed substantially into an inverted u-shape having two ends and a middle, and wherein the third flexible framing rod 34 crosses the first flexible framing rod 20 and the second flexible framing rod 30 near the apex of the inverted u-shape. Like the first and second flexible framing rods (20 & 30), the flexible skin 10 is non-removably connected to the two ends 22 of third flexible framing rod 34. Unlike the first and second flexible framing rods (20 & 30), the third flexible framing rod 34 is removably connected to the middle of the flexible skin 10. Removably connecting the flexible skin 10 to the middle of the third framing rod permits the first, second, and third framing rods to be rotated relative to each other for easier storage as discussed below. More flexible framing rods can be added in the same manner as the third flexible framing rod 34 described herein.

It is preferred to removably connect the flexible skin 10 to the middle of the third flexible framing rod 34 by a plurality of framing rod hooks 36. The framing rod hooks 36 can be removably connected to the flexible skin 10 by the use of fabric loop 38. The fabric loop 38 can be sewn into the flexible skin 10. In operation, the fast-erecting tent shown in FIG. 1C will spring roughly into shape when released in a substantially upright position, largely due to the first and second flexible framing rods (20 & 30) trying to straighten out and the flexible skin 10 holding them in an inverted u-shape. Once released in a substantially upright position, a user can then manually connect the framing rod hooks 36 to the third framing rod 34 to create the fast-erecting tent shown in FIGS. 1C and 1D. To dismantle the tent, a user would simply manually disconnect the framing rod hooks 36 from the third flexible framing rod 34, rotate the three flexible framing rods (20, 30, 34) until they become substantially aligned with each other, and store the fast-erecting tent in a storage bag as described more fully below.

Figure 6:
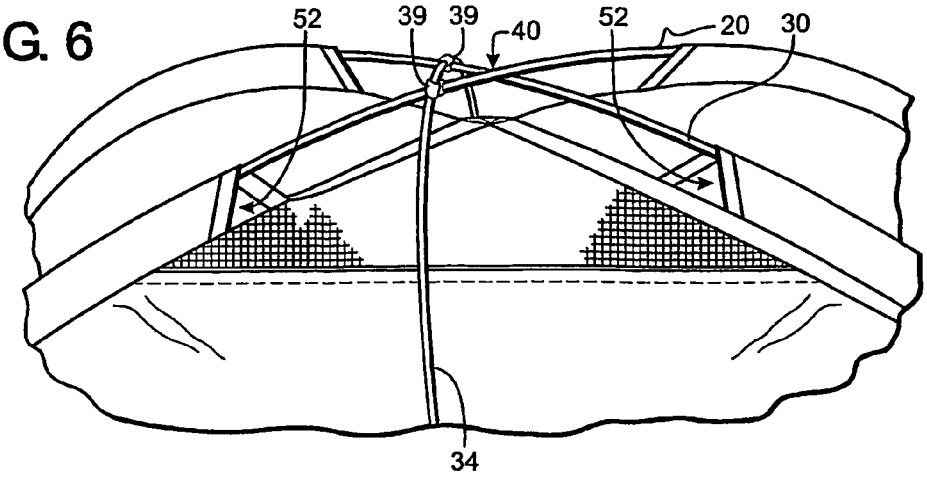
FIG. 6 illustrates an optional offset connection for the intersection 40.
Figure 6A:
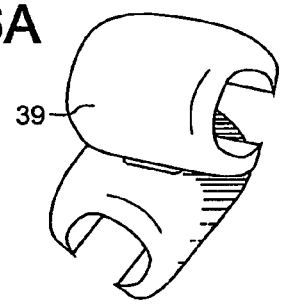
FIG. 6A illustrates an embodiment for an offset connector piece shown in FIG. 6.

Alternatively, to provide more structural stability, the third flexible framing rod 34 can cross the first flexible framing rod 20 and the second flexible framing rod 30 at a location offset from where the first flexible framing rod 20 and the second flexible framing rod 30 cross each other as shown in FIG. 6. To accomplish this, it is preferred to connect the third flexible framing rod 34 to the first flexible framing rod 20 and the second flexible framing rod 30 using connections ordinarily used to removably connect two intersecting rods, such as the plastic connector 39 shown in FIG. 6A.

Figure 17:
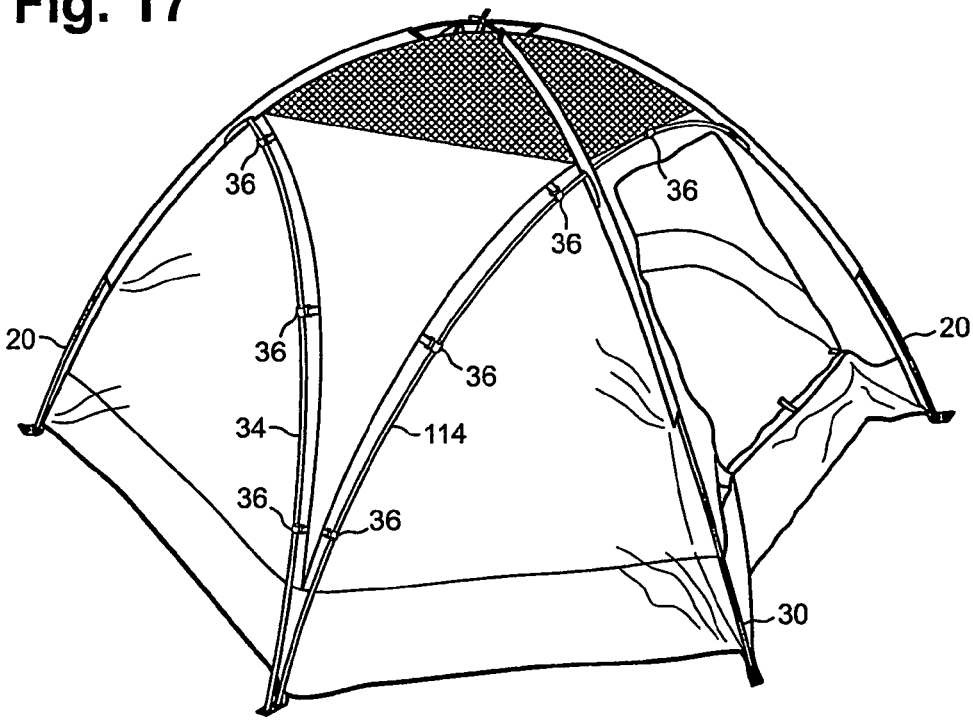
FIGS. 17, 17A and 17B illustrate an additional embodiment having four flexible framing rods with a hexagonal base configuration.
Figure 17A:
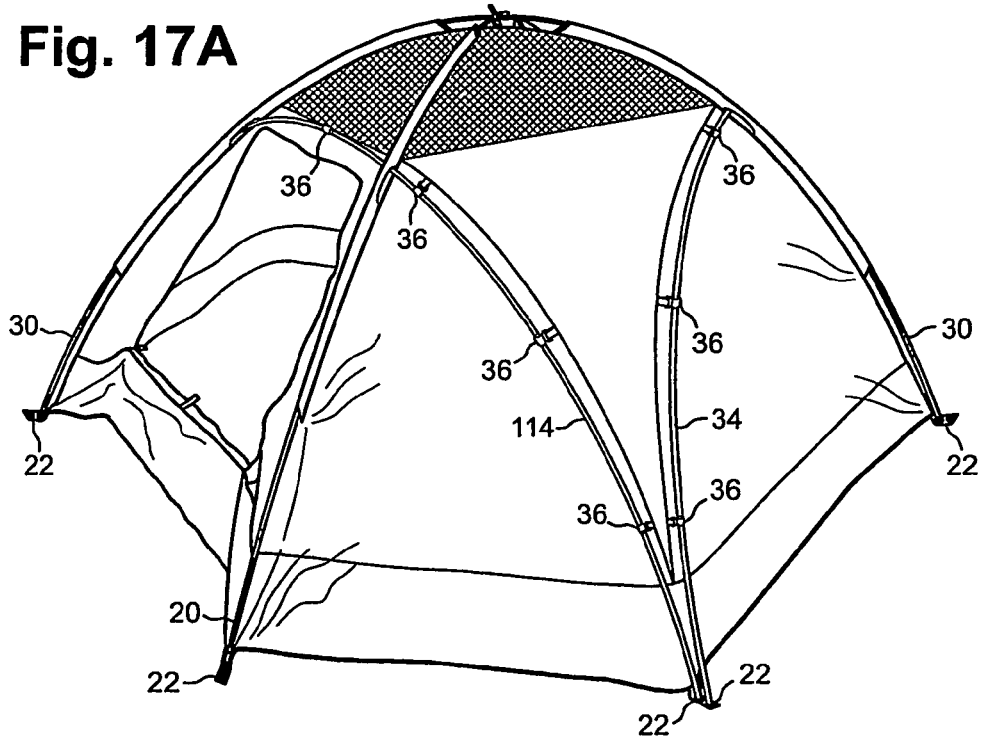
Figure 17B:
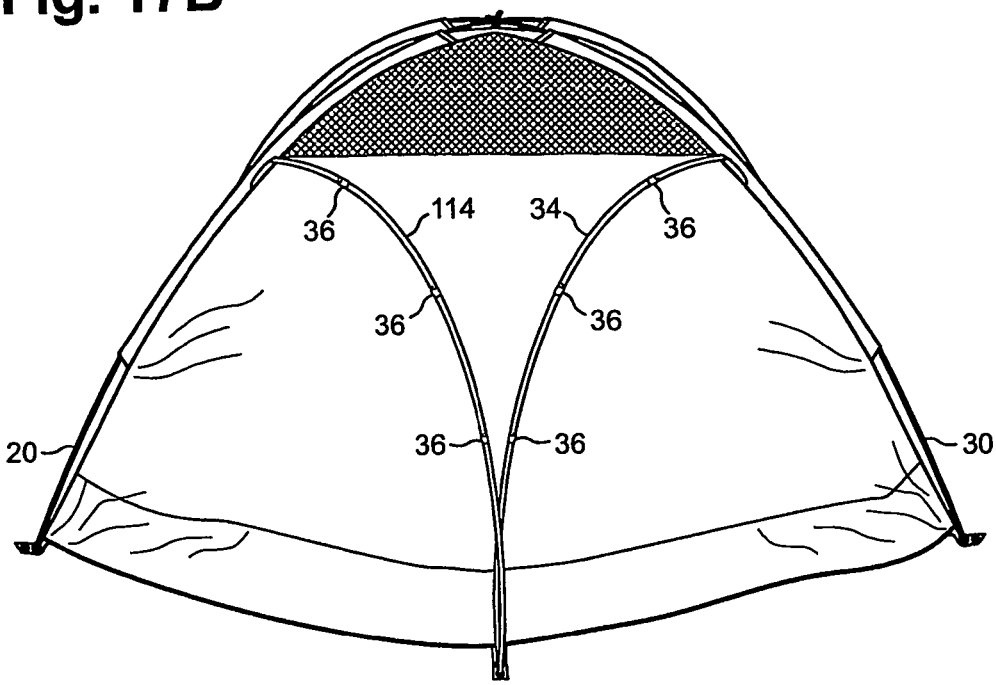
Figure 17C:
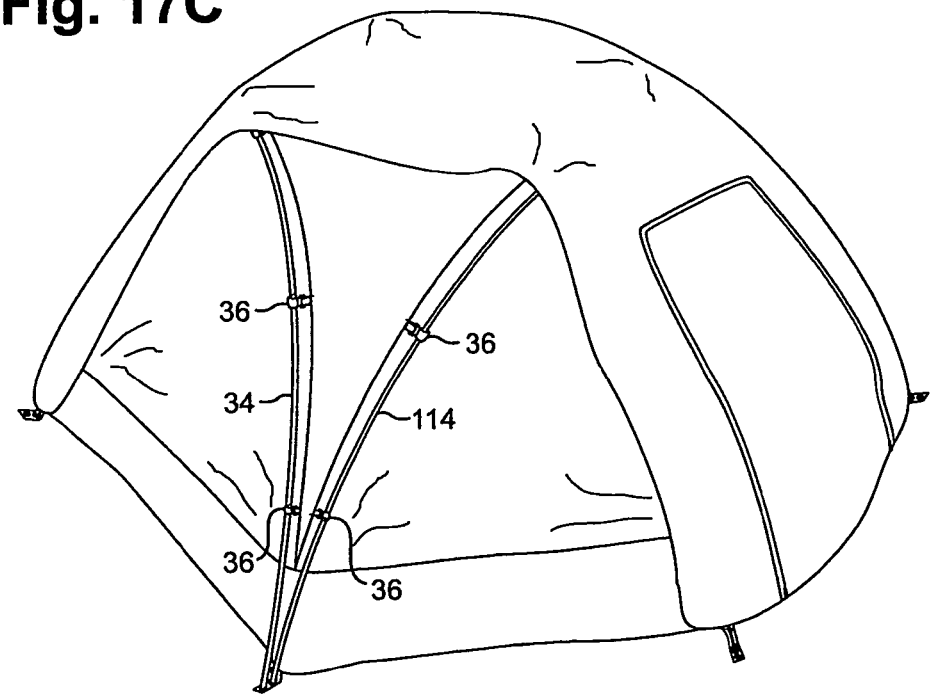
FIG. 17C illustrates an additional embodiment having four flexible framing rods with a hexagonal base configuration and an optional fly.

The fast-erecting portable structure can optionally include a fourth flexible framing rod 114. Shown in FIGS. 17-17C is one embodiment having a fourth framing rod 114. In this embodiment, neither the third framing rod 34 nor the fourth framing rod 114 crosses the apex of the tent. Instead, the third and fourth framing rods (34 & 114) split away from each other at the base and intersect the first and second flexible framing rods (20 & 30) at points offset from the apex of the tent. This offset adds structural stability to the frame. Like the first and second flexible framing rods (20 & 30), the flexible skin 10 is non-removably connected to the two ends 22 of the third and fourth framing rods (34 & 114). Unlike the first and second flexible framing rods (20 & 30), the third and fourth framing rods (34 & 114) are removably connected to the middle of the flexible skin 10. Removably connecting the flexible skin 10 to the middle of the third and fourth framing rods (34 & 114) permits the first, second, third and fourth framing rods to be rotated relative to each other for easier storage as discussed below. More flexible framing rods can be added in a similar manner.

It is preferred to removably connect the flexible skin 10 to the middle of the third and fourth framing rods (34 & 114) by a plurality of framing rod hooks 36. The framing rod hooks 36 can be removably connected to the flexible skin 10 by the use of fabric loop 38. The fabric loop 38 can be sewn into the flexible skin 10. In operation, the fast-erecting tent shown in FIGS. 17-17C will spring roughly into shape when released in a substantially upright position, largely due to the first and second flexible framing rods (20 & 30) trying to straighten out and the flexible skin 10 holding them in an inverted u-shape. Once released in a substantially upright position, a user can then manually connect the framing rod hooks 36 to the third and fourth framing rods (34 & 114) to create the fast-erecting tent shown in FIGS. 17-17C. To dismantle the tent, a user would simply manually disconnect the framing rod hooks 36 from the third and fourth framing rods (34 & 114), rotate the four flexible framing rods (20, 30, 34, 114) until they become substantially aligned with each other, and store the fast-erecting tent in a storage bag as described more fully below.

Figure 18:
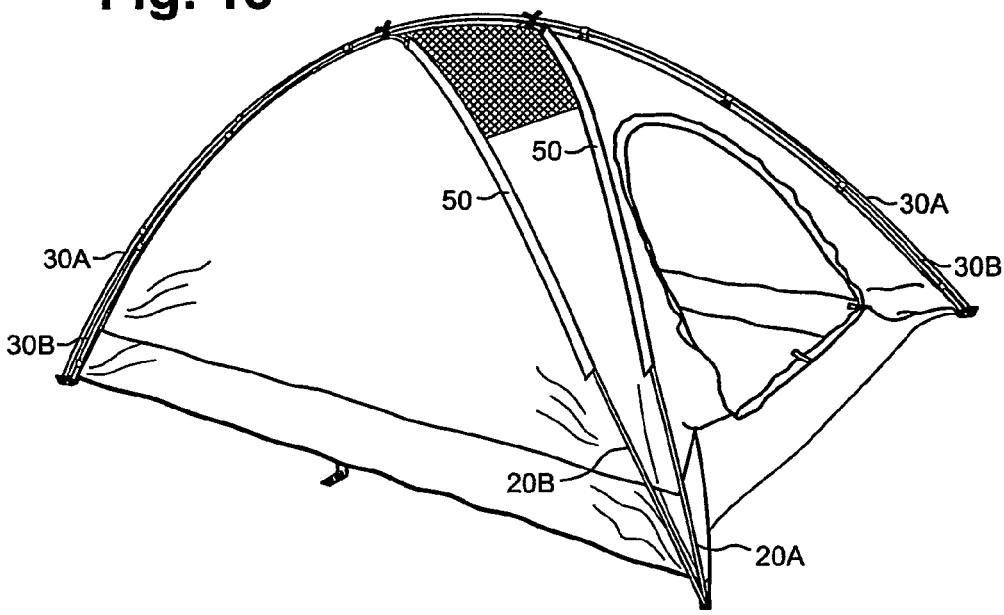
FIGS. 18, 18A, 18B and 18C illustrate an additional embodiment having four flexible framing rods with a rectangular base configuration.
Figure 18A:
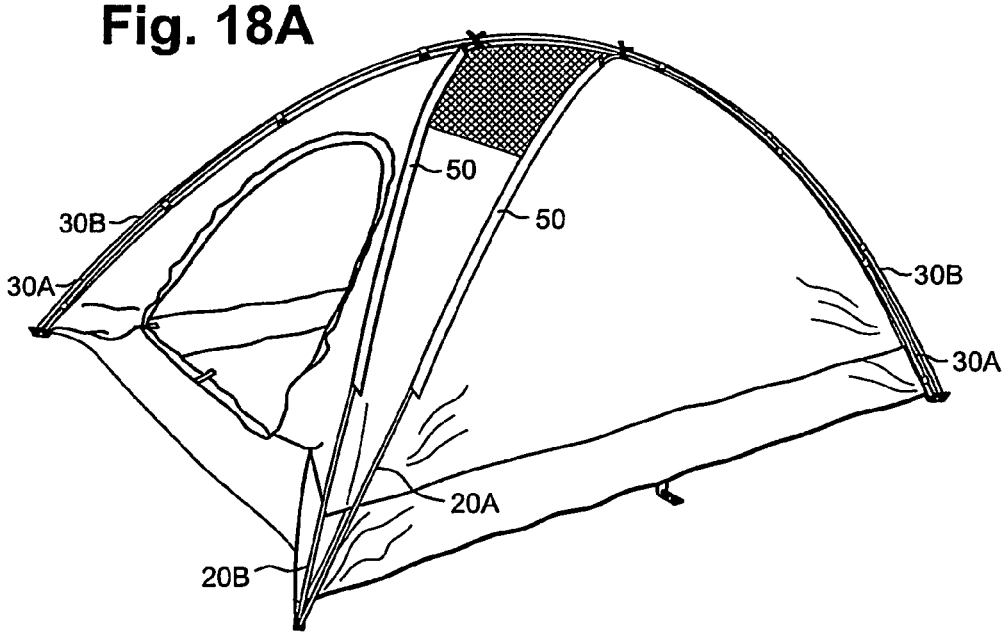
Figure 18B:
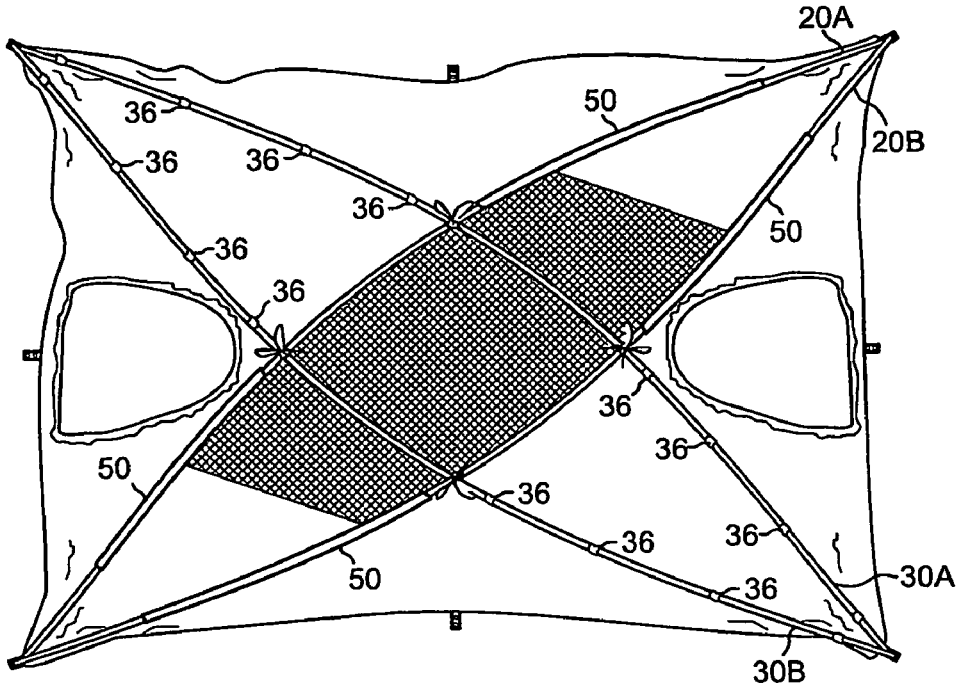
Figure 18C:
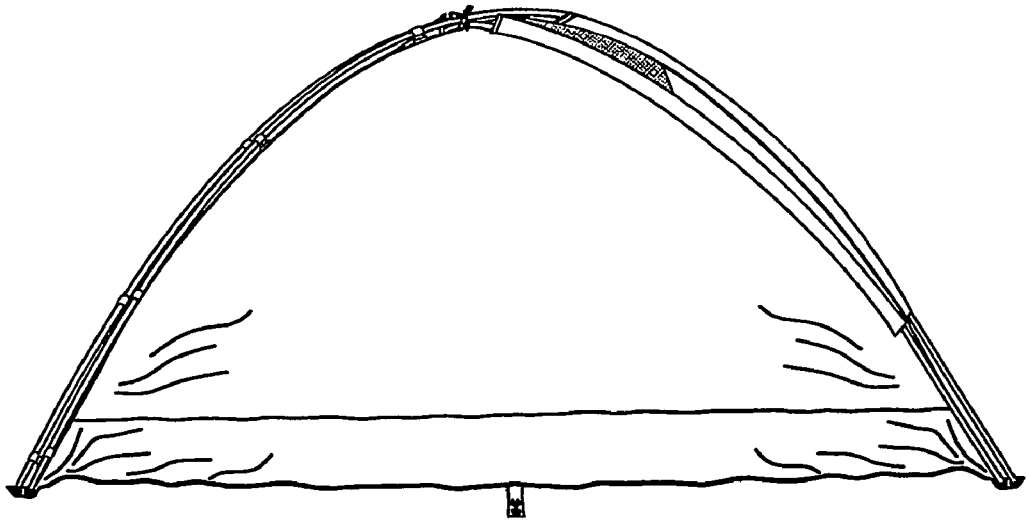
Figure 18D:
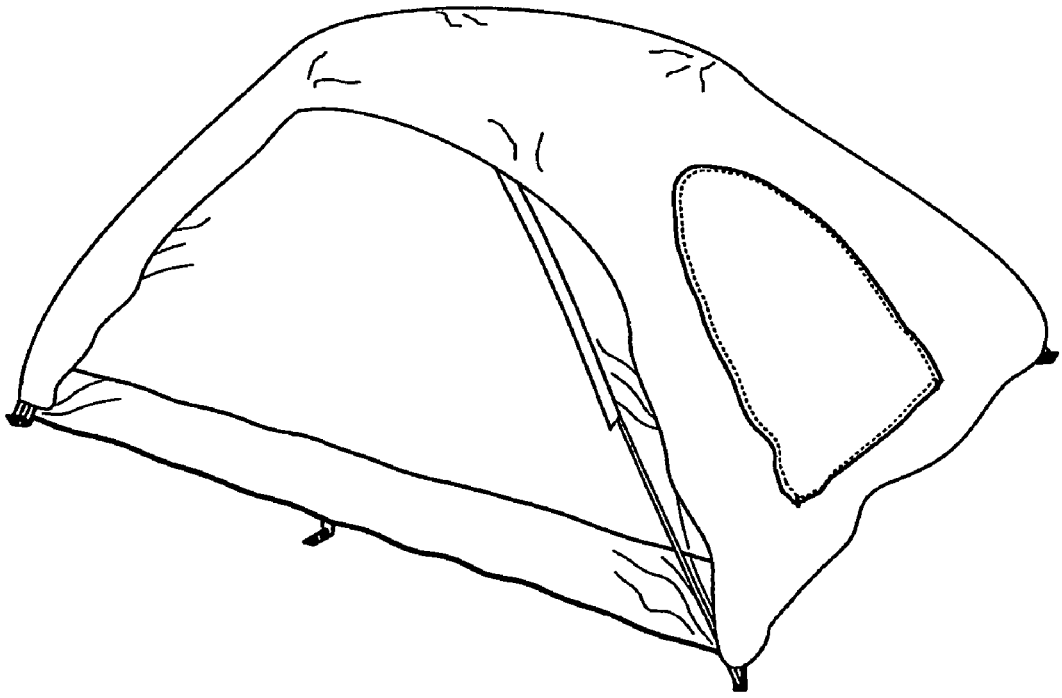
FIG. 18D illustrates an additional embodiment having four flexible framing rods with a rectangular base configuration and an optional fly.

Another embodiment is shown in FIGS. 18-18D. The embodiment shown in FIGS. 18-18D is similar to the tent shown in FIGS. 1 and 1A, except that flexible framing rod 20 is replaced with a first pair of flexible framing rods 20A and 20B and flexible framing rod 30 is replaced with a second pair of flexible framing rods 30A and 30B. In this embodiment, none of the flexible framing rods (20A, 20B, 30A, 30B) cross the apex of the tent. Instead, each pair of flexible framing rods (20A & 20B) and (30A & 30B) split away from each other at the base and intersect each other at points offset from the apex of the tent. This offset adds structural stability to the frame.

Like the first and second flexible framing rods (20 & 30), the flexible skin 10 is non-removably connected to the ends of the flexible framing rods (20A, 20B, 30A, 30B). Like the first and second flexible framing rods (20 & 30), the first pair of flexible framing rods 20A & 20B are slidably connected to the flexible skin 10 by sleeves 50. Unlike the first and second flexible framing rods (20 & 30), second pair of flexible framing rods 30A & 30B are removably connected to the middle of the flexible skin 10. Removably connecting the flexible skin 10 to the middle of the second pair of flexible framing rods 30A and 30B permits the flexible framing rods (20A, 20B, 30A, 30B) to be rotated relative to each other for easier storage as discussed below. More flexible framing rods and different configurations can be added in a similar manner.

The fast-erecting portable structure can be stored by coiling the flexible framing rods (e.g., 20, 30, 34, 114, 20A, 20B, 30A, 30B) into a storage bag 60. It is preferred that the storage bag 60 be disk shaped but most any shape will suffice because the flexible framing rods will conform to the shape most bags. It is also preferred that the storage bag 60 have an interior pocket 62. The interior pocket 62 is valuable for assistance in coiling the flexible framing rods (20 & 30) into the storage bag 60. In addition to (or in place of) the interior pocket 62, a cinch-able strap 112 can be connected to the bag and used to hold the ends of the flexible framing rods when coiling the flexible framing rods into the storage bag. The purpose of the interior pocket 62 and/or the cinchable strap 112 is to anchor the ends 22 relative to the storage bag 60 while coiling the flexible framing rods into the storage bag 60.

Figure 15:
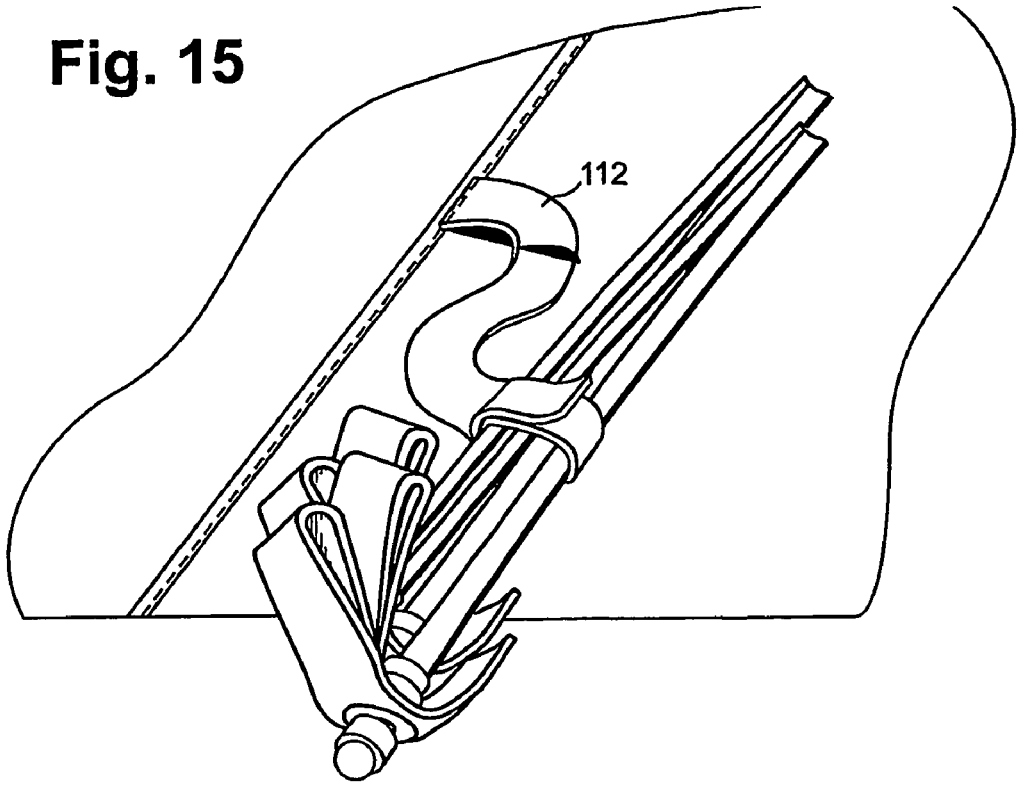
FIG. 15 illustrates one embodiment of a cinch-able strap.
Figure 15A:
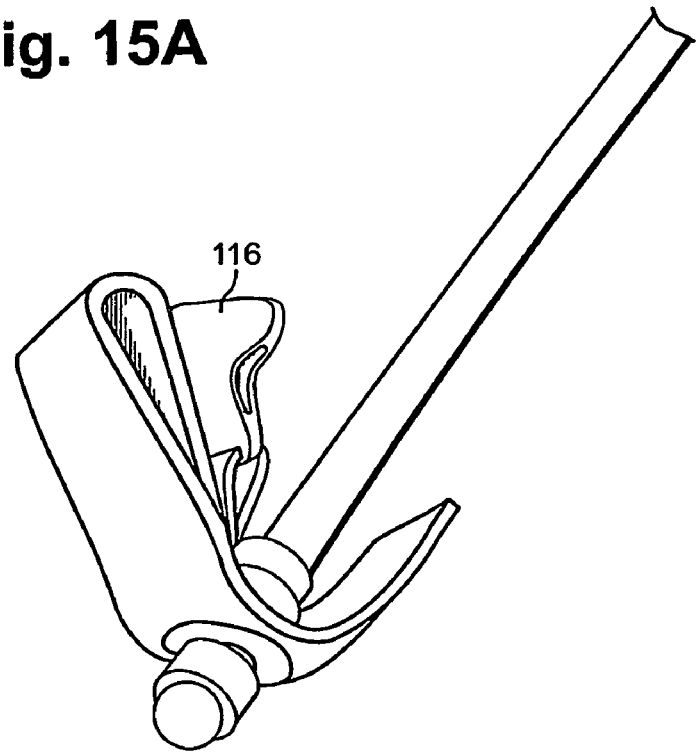
FIG. 15A illustrates an additional embodiment of a non-removable connection between the flexible framing rod and a flap also having a removable connector 116 for an optional fly.
Figure 15B:
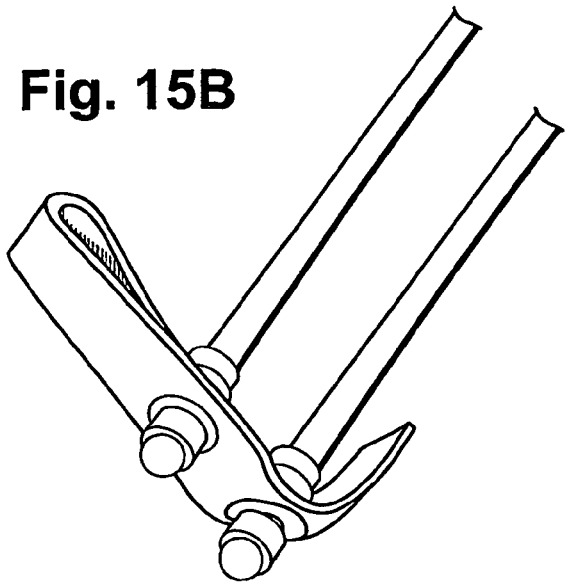
FIG. 15B illustrates an additional embodiment of a non-removable connection between two flexible framing rods and a flap.

One embodiment of a cinch-able strap is shown in FIG. 15. A strap 112 can be sewn into the storage bag 60 on one end and wrapped around the flexible framing rods on the other. By using a strap 112 having VELCRO® on each side (hooks on one side and pile on the other), the strap 112 can be wrapped around the flexible framing rods to secure them from moving in relation to each other and assist in keeping them in the interior pocket 62. Of course other known releasable connections can be used, such as snaps, buttons, zippers, knots, etc.

Figure 4A:
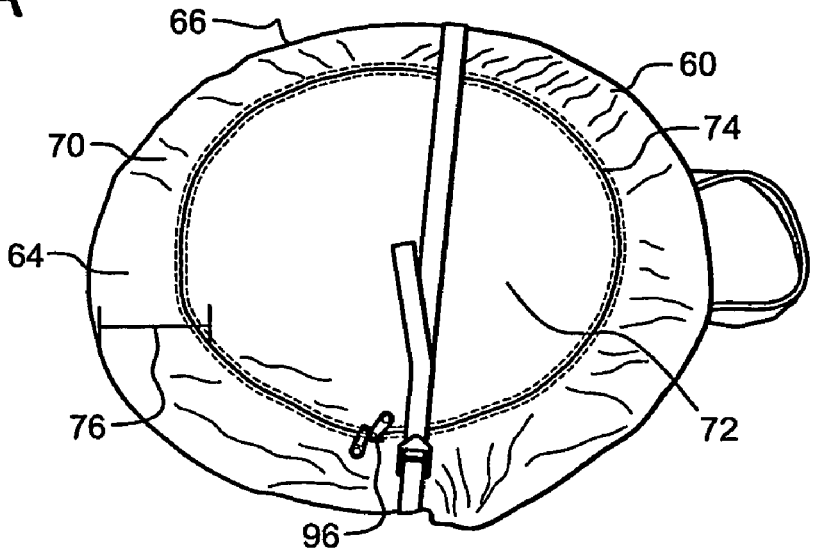
FIG. 4A illustrates a view of a storage bag.
Figure 4B:
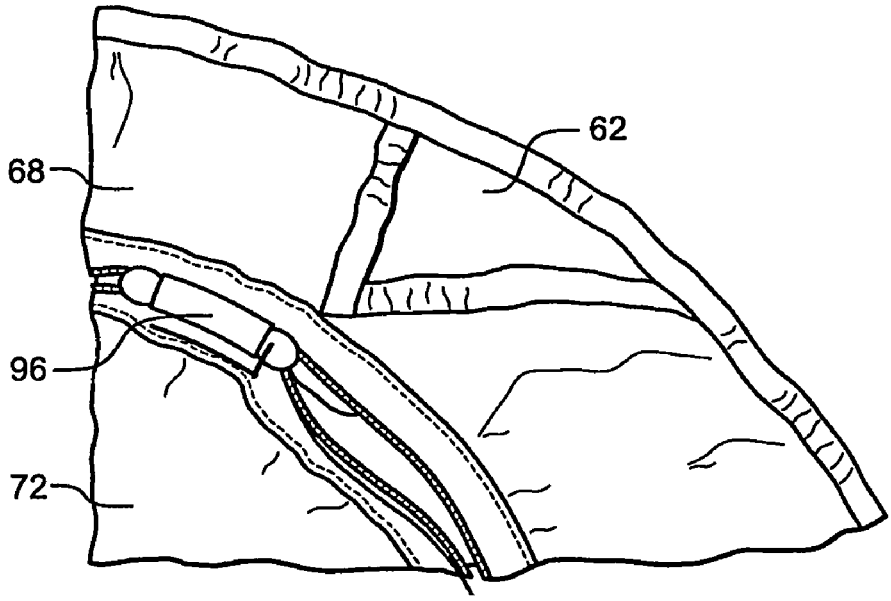
FIG. 4B illustrates a view looking out from inside of a storage bag showing an interior pocket 62.

As shown in FIG. 4A, the preferred embodiment of storage bag 62 comprises a front sheet 64 having a front sheet perimeter 66, a front sheet inside face 68, a front sheet outside face 70, an opening flap 72, and an opening flap perimeter 74, wherein the distance 76 between the opening flap perimeter 74 and the front sheet perimeter 66 is at least one inch, a back sheet 78 having a back sheet perimeter 80, a back sheet inside face 82, a back sheet outside face 84, and a first pocket 86, wherein the first pocket 86 is connected to the back sheet inside face 82 near the back sheet perimeter 80 and the front sheet perimeter 66 is connected to the back sheet perimeter 80. Optionally, the storage bag 60 can further comprise a spacer 88 having a first edge 90 and a second edge 92, wherein the first edge 90 of the spacer 88 is connected to the front sheet perimeter 66 and the second edge 92 of the spacer 88 is connected to the back sheet perimeter 80.

Figure 13:
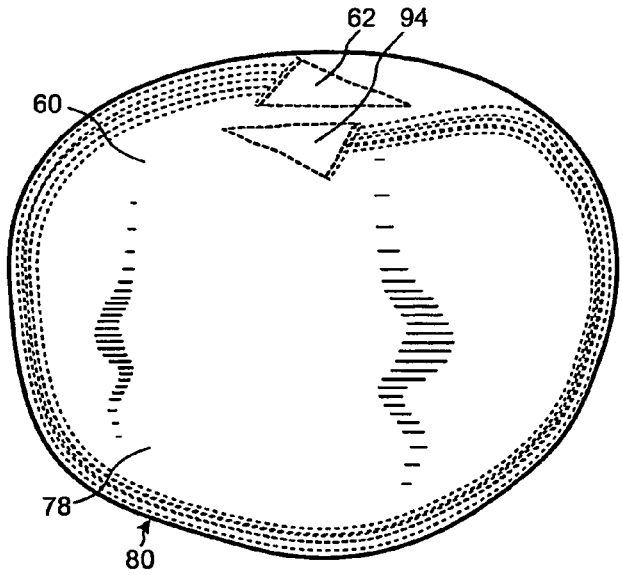
FIG. 13 illustrates a view of the back side of a bag showing the flexible framing rods coiled inside the back with the ends in the interior pockets.
Figure 14:
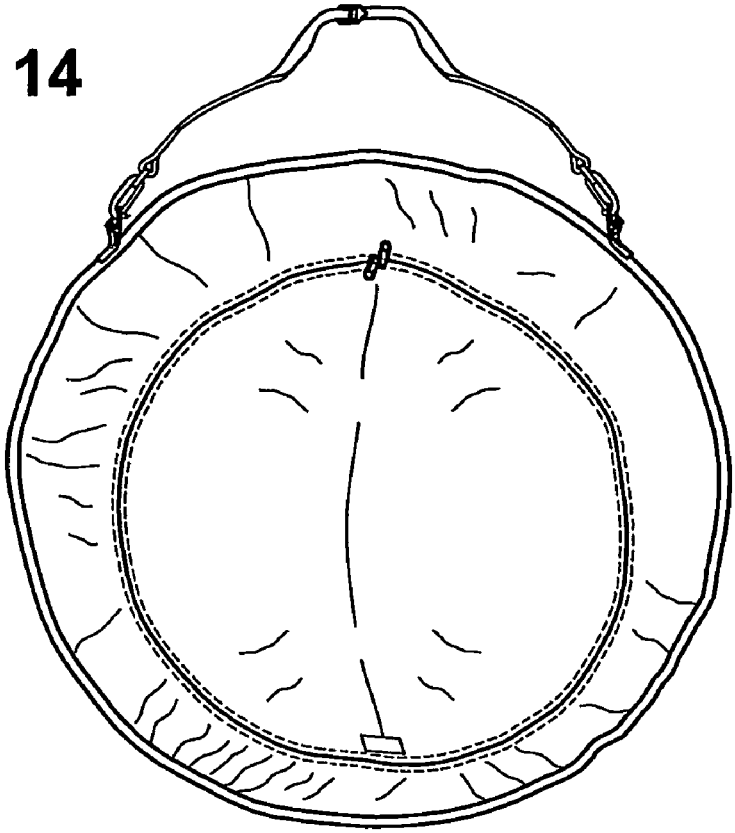
FIG. 14 illustrates a front view of an additional embodiment of the storage bag.
Figure 14A:
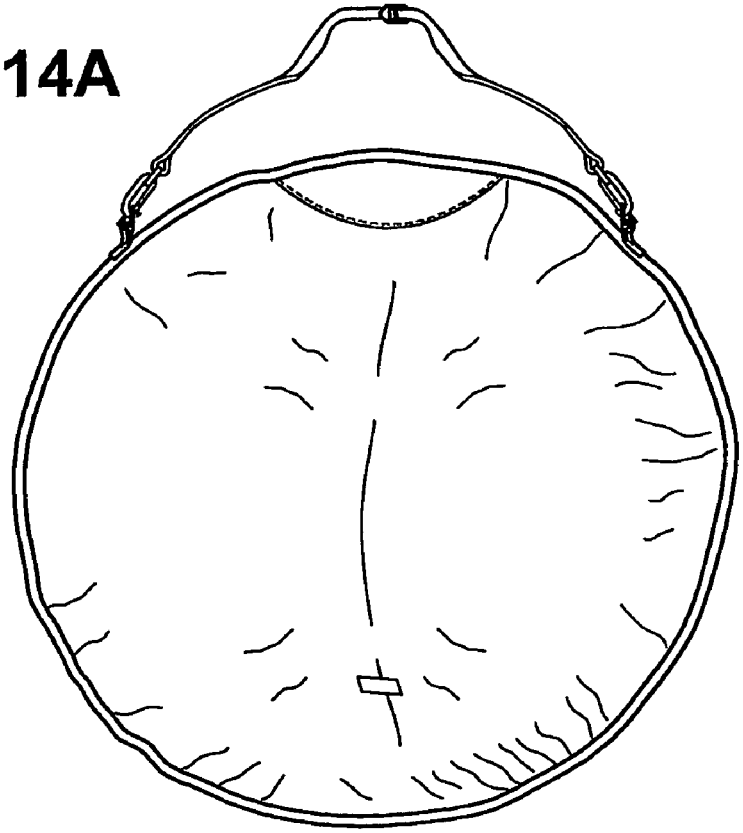
FIG. 14A illustrates a back view of an additional embodiment of the storage bag.

The storage bag can also comprise a second pocket 94 connected to the front sheet inside face 68 of the near the front sheet perimeter 66. Preferably, the orientation of the first pocket 86 and the second pocket 94 is as shown in FIG. 13, wherein the opening of the first pocket 86 is in the opposite direction of the second pocket 94. It is also preferred that the storage bag have a zipper 96 connected to the front sheet along the opening flap perimeter 74. The storage bag 60 can be in the shape of a circular disk. It is preferred, though, that the storage bag be in the shape of an elongated circular disk as shown in FIG. 13.

Figure 5A:
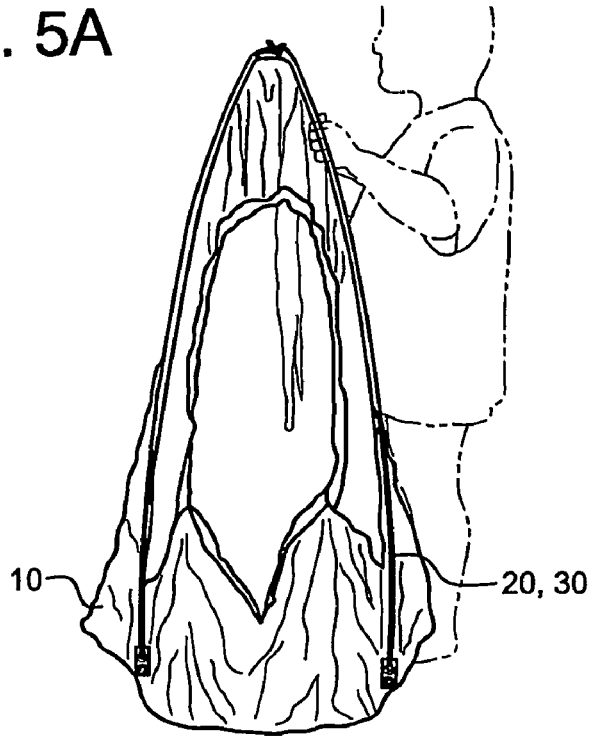
FIGS. 5A-5R illustrate the preferred steps to coil and stow the tent in a storage bag.
Figure 5B:
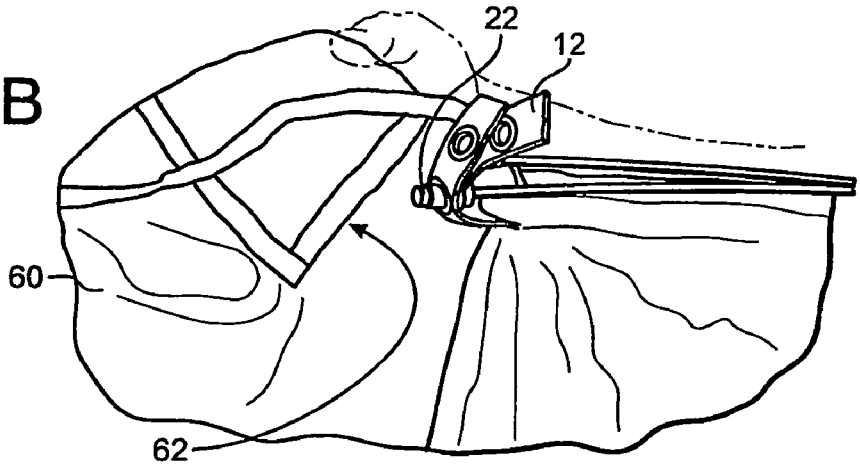
FIG. 5S illustrates an additional embodiment of the storage bag having a spacer 88.
Figure 5C:
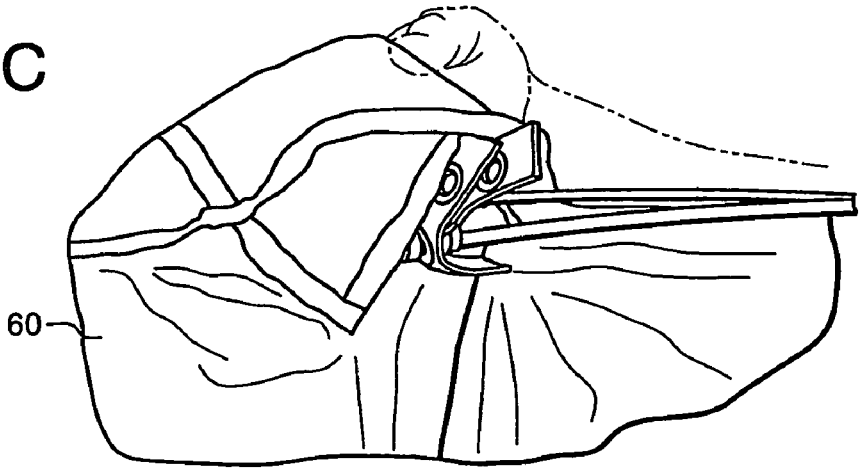
Figure 5D:
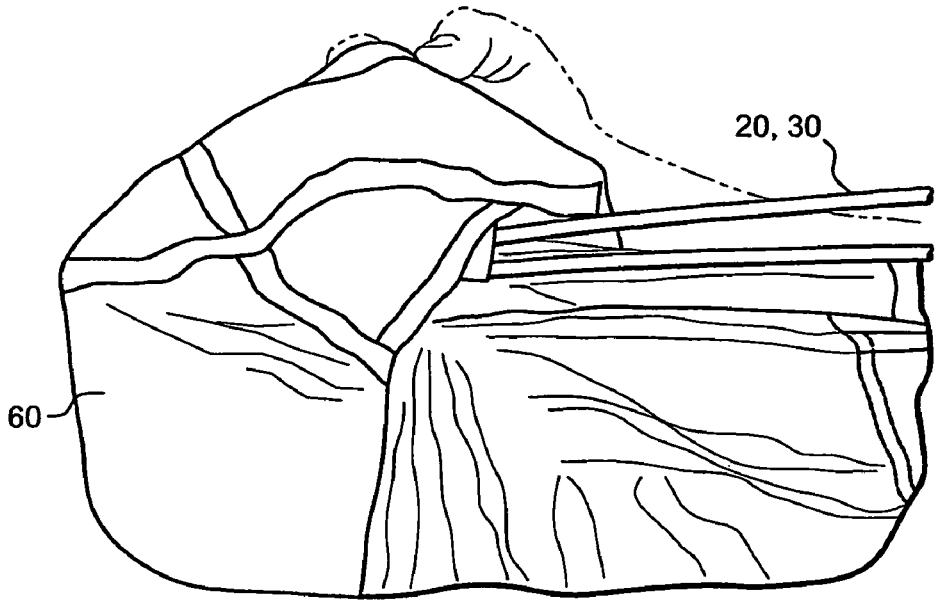
Figure 5E:
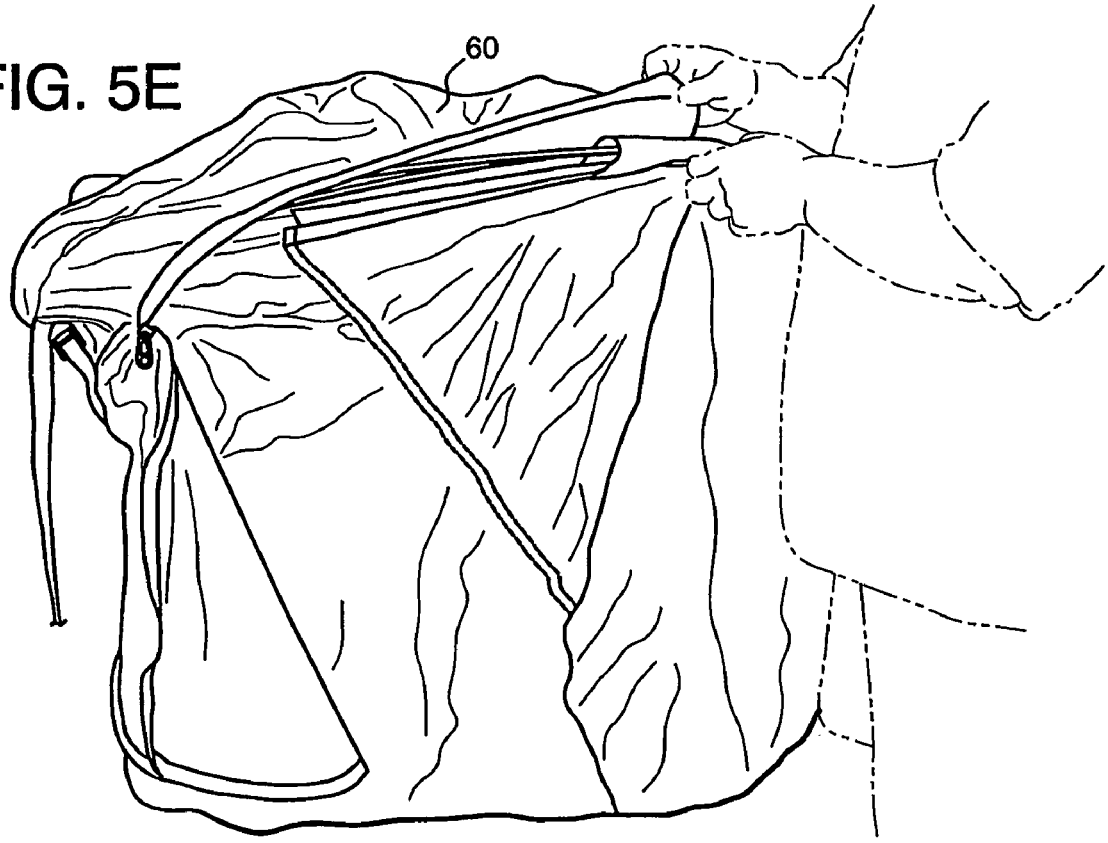
Figure 5F:
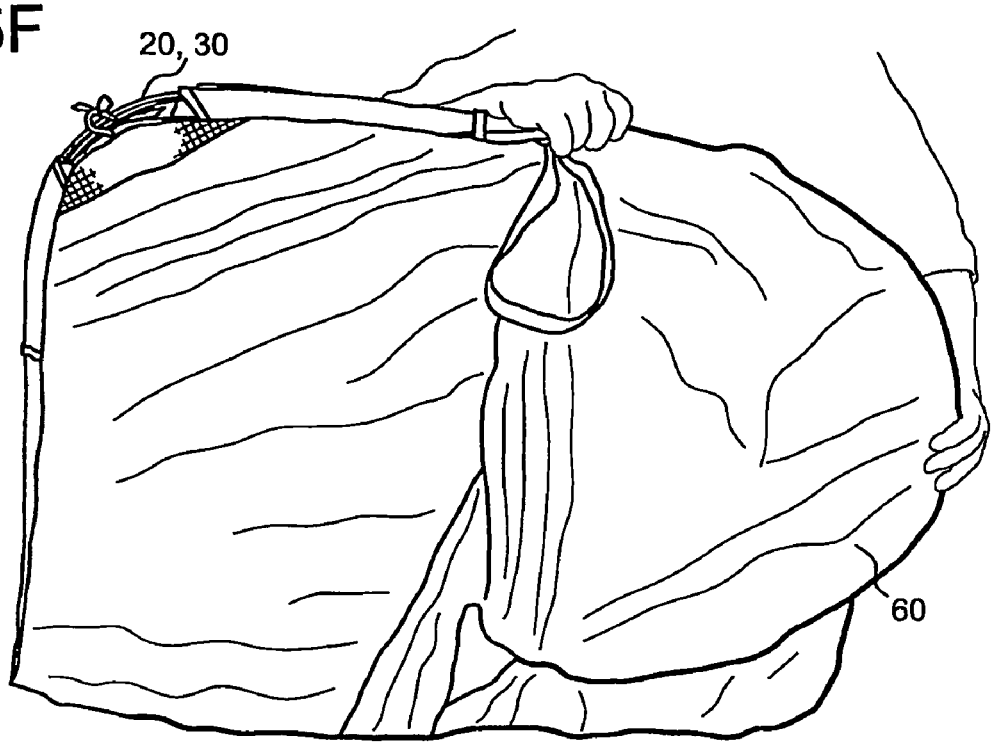
Figure 5G:
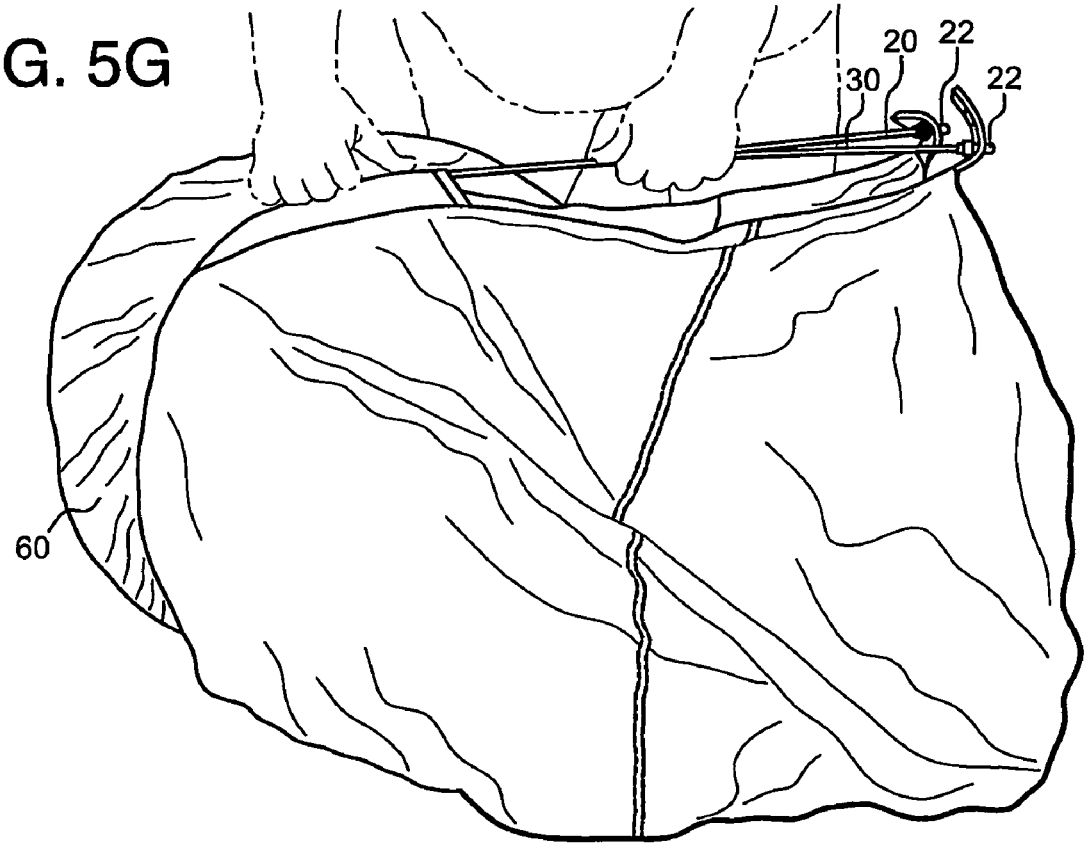
Figure 5H:
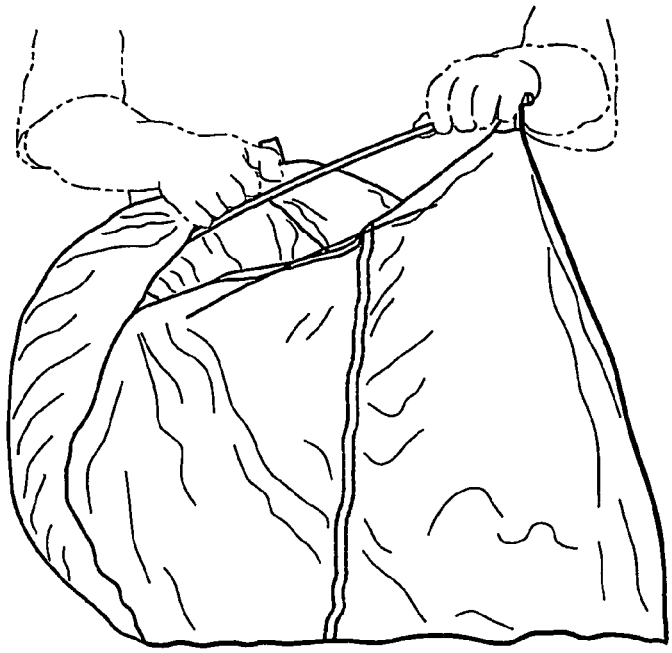
Figure 5I:
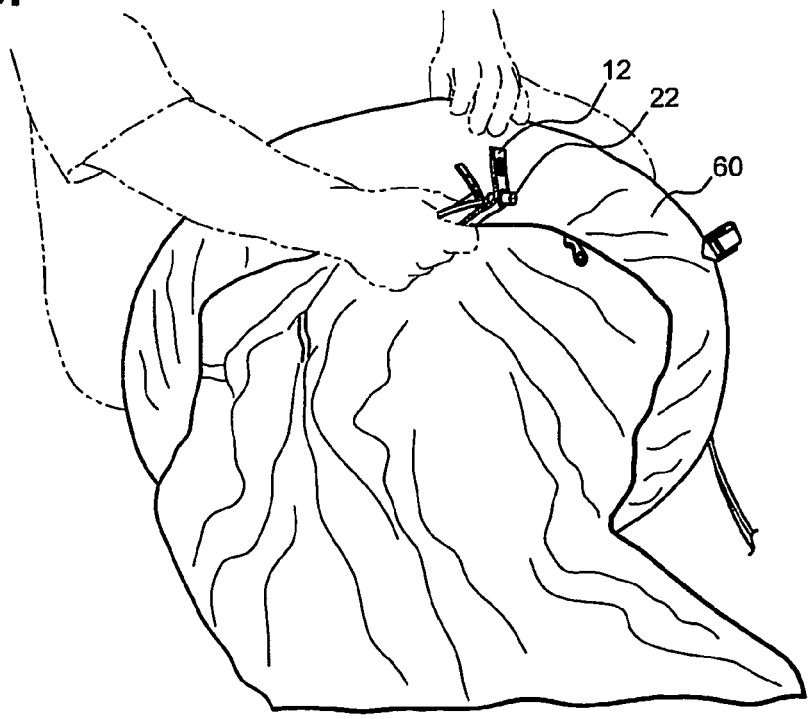
Figure 5J:
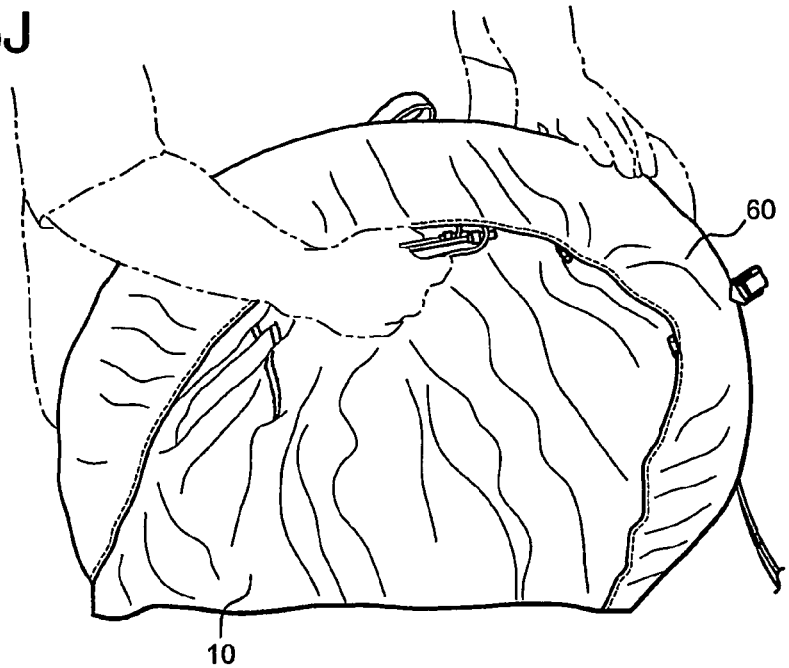
Figure 5K:
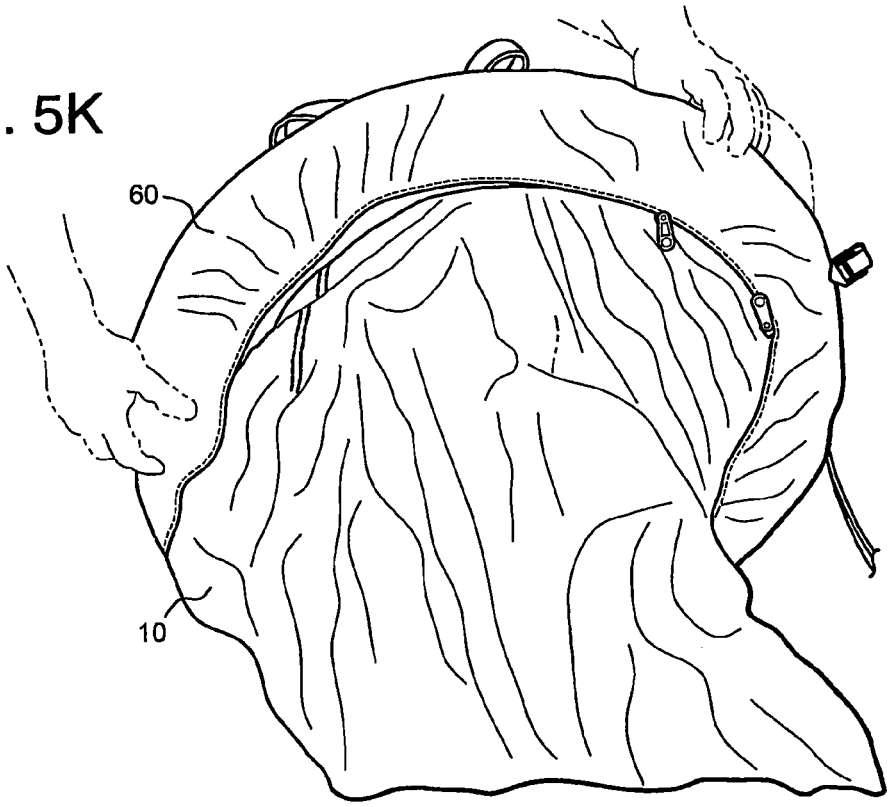
Figure 5L:
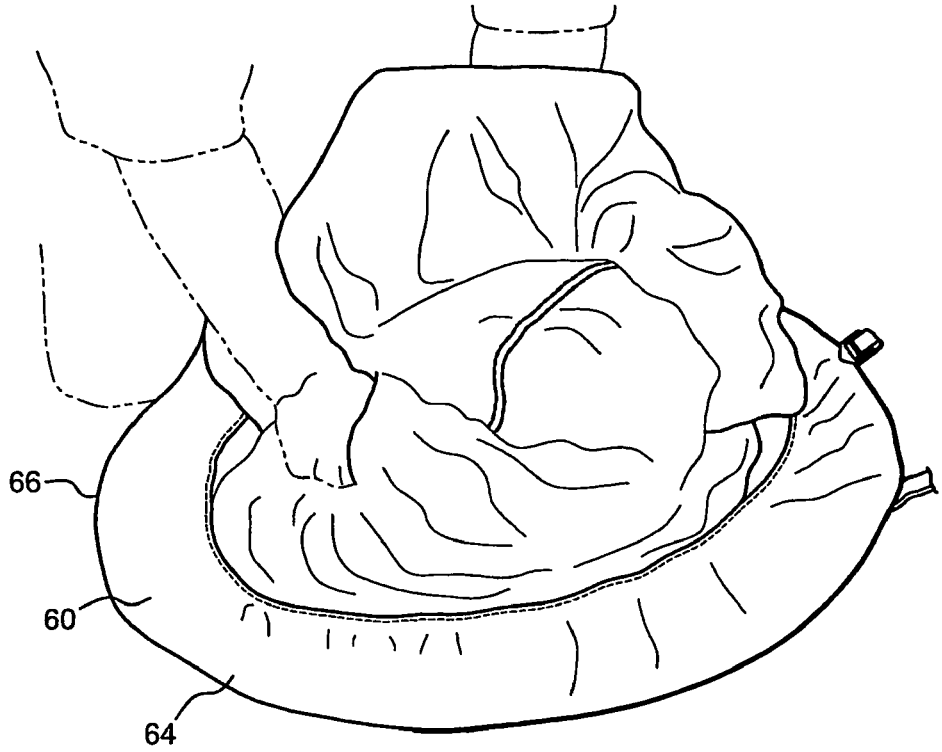
Figure 5M:
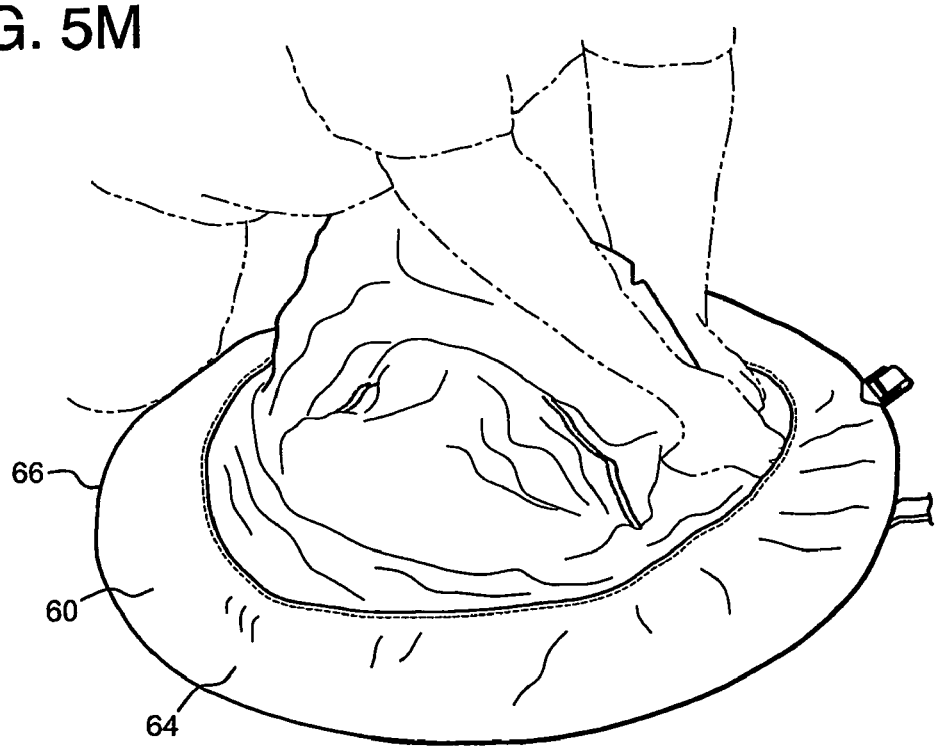
Figure 5N:
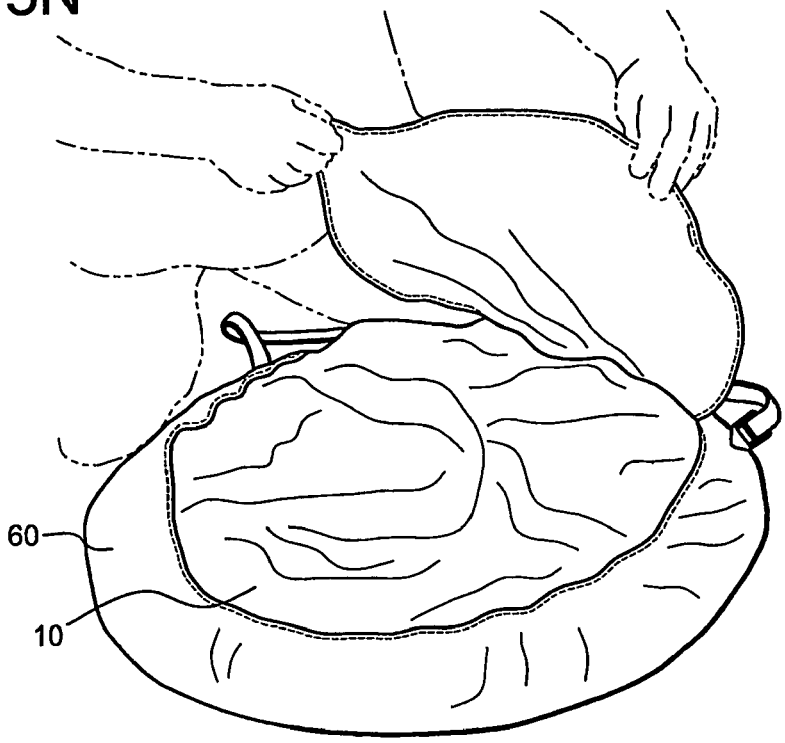
Figure 5O:
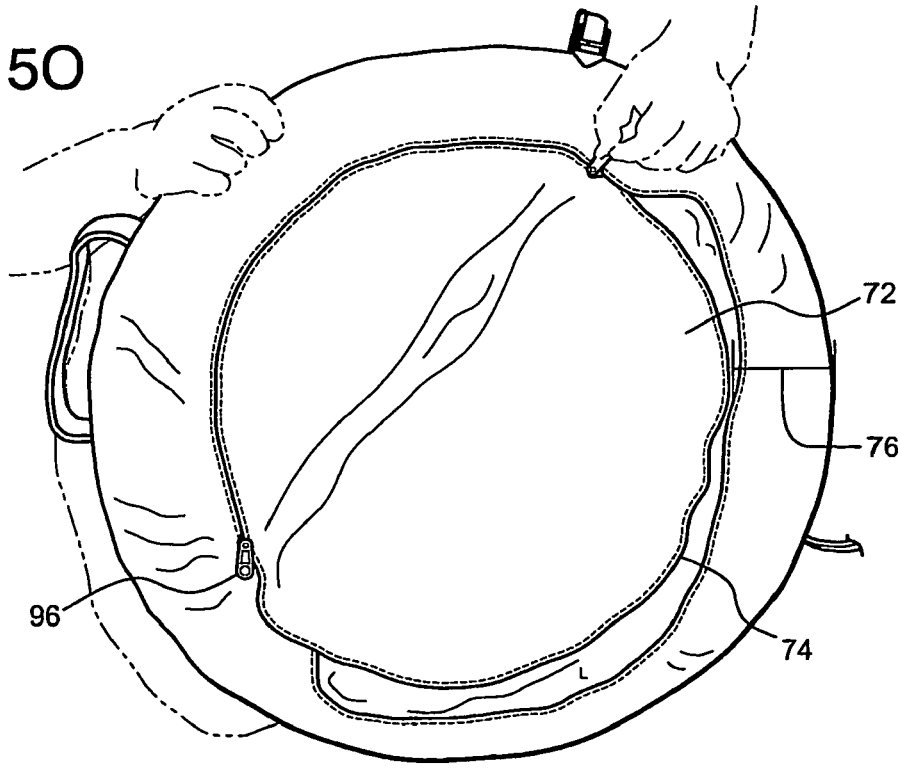
Figure 5P:
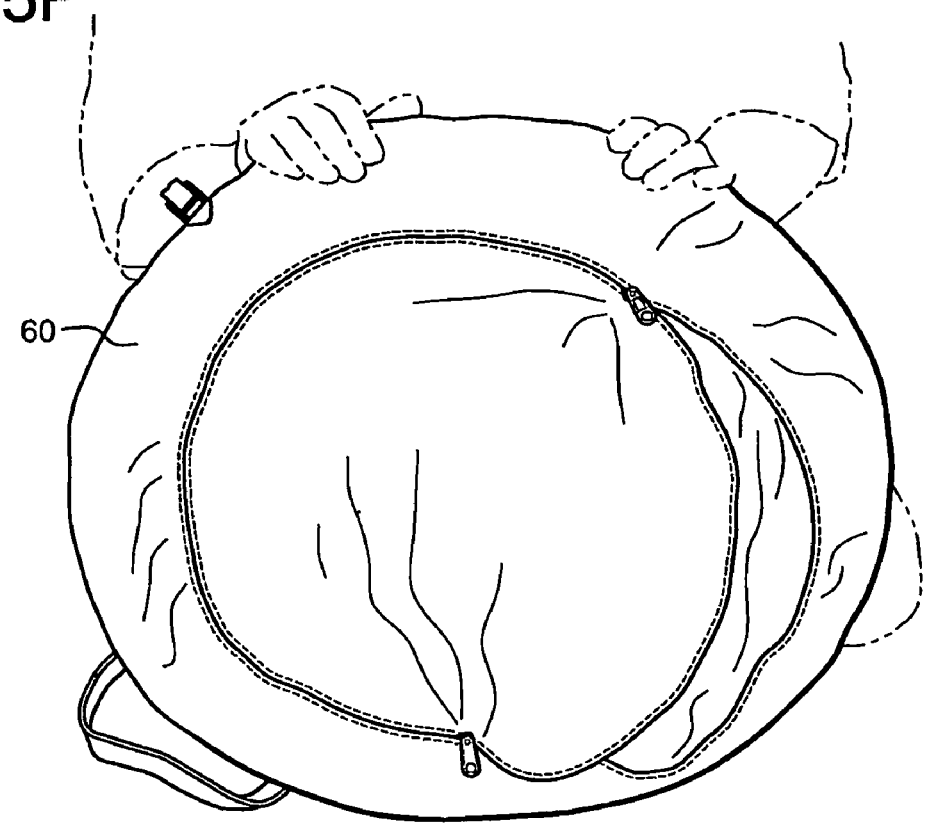
Figure 5Q:
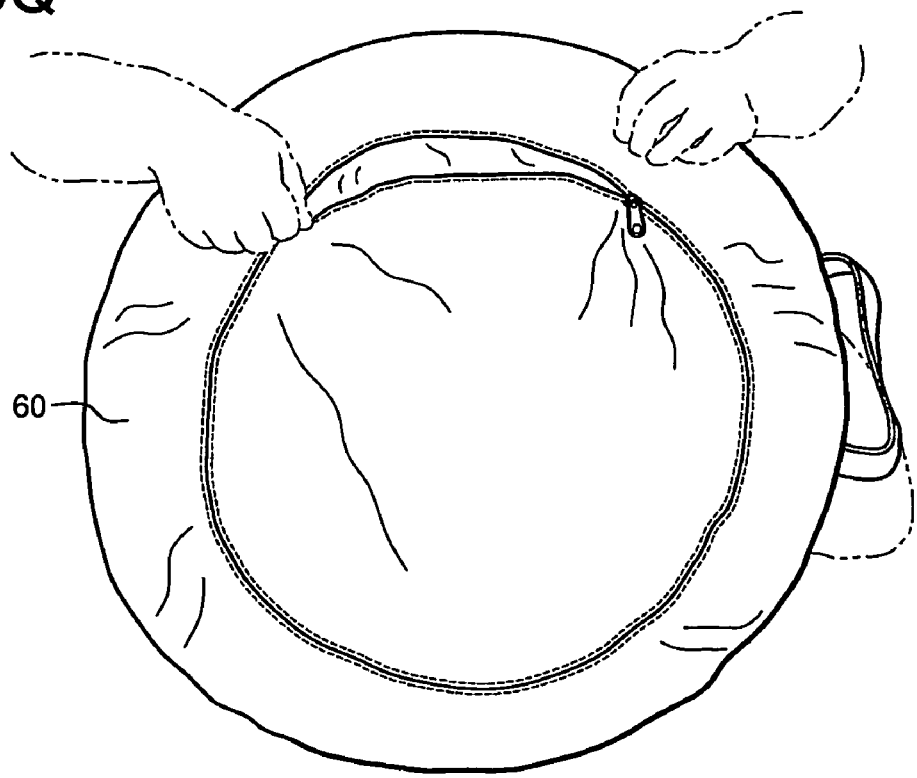
Figure 5R:
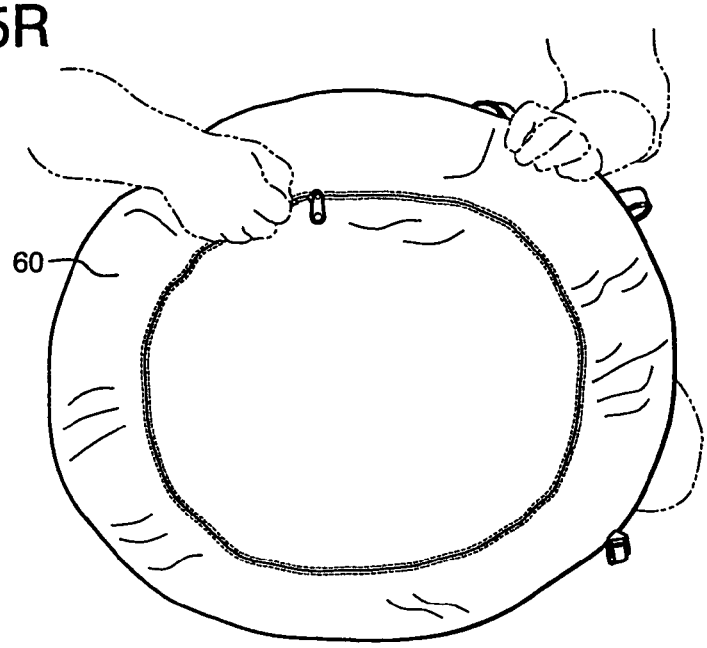
Figure 5S:
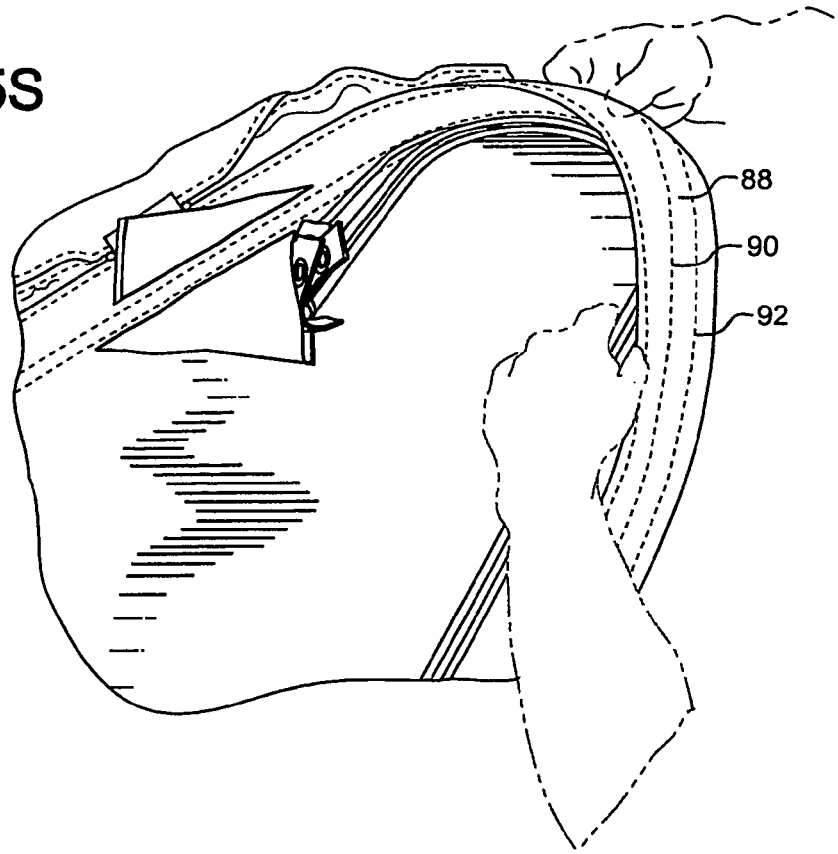

As illustrated in FIGS. 5A-5R, it is preferred to coil and stow the fast-erecting portable structure by use of the following steps. The first step is to rotate the first framing rod 20 relative to the second framing rod 30 so that they are roughly parallel to and next to each other. See FIG. 5A. The second step is to insert one end 22 of the first framing rod 20 and one end 22 of the second framing rod 30 into the interior pocket 62. See FIGS. 5B-5E, and see FIG. 5S for the alternate embodiment having a spacer 88 and a first pocket 86 and second pocket 94. The third step is to incrementally coil the first framing rod 20 and the second framing rod 30 into the storage bag 60 working from the ends 22 of the framing rods (20 & 30) and tucking the framing rod into the storage bag at approximately one foot of flexible framing rod (20 & 30) at a time until the entire length of framing rods (20 & 30) are coiled inside the storage bag 60. See FIGS. 5E-5J. The fourth step is to stuff the flexible skin 10 into the storage bag 60. See FIGS. 5K and 5N. The fifth step is to close the storage bag 60. See FIGS. 5O and 5R. It is preferred that the storage bag 60 be opened and closed by the use of a zipper 96.

Figure 16:
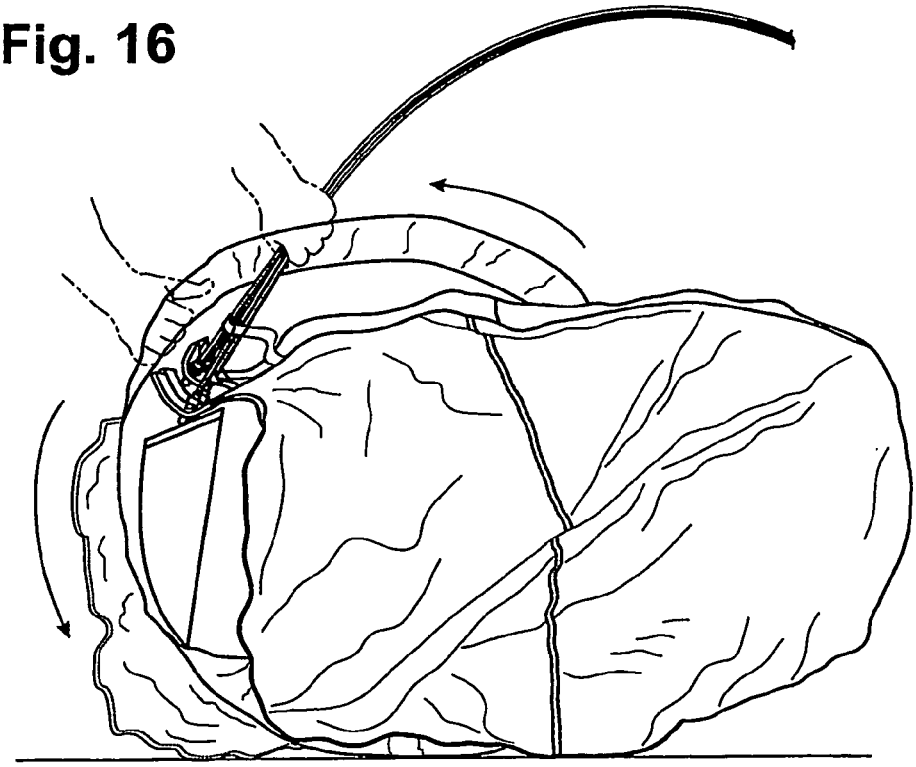
FIG. 16 illustrates an optional additional step of inserting the flexible framing rods into the storage pocked and then rotating the ends and the bag along the ground to assist with coiling the flexible framing rods into the storage bag.

An alternative additional step can also be employed. After inserting the framing rod ends 22 into the interior pocket 62, the ends 22 (inside the interior pocket 62) can be placed on the ground for stability. The ends 22 can be then rotated as shown in FIG. 16 and the framing rods (20 & 30) can be incrementally coiled into the storage bag 60 as the storage bag 60 is rotated along the ground. This allows a single person to have on and on the framing rods (20 & 30) already coiled inside the storage bag 60 and the other hand free to incrementally coil more length of framing rod (20 & 30) and the ground keeping the bottom of the storage bag 60 stabilized.

To set up the four-paneled embodiment of the fast-erecting portable shelter once it has been coiled and stowed in the storage bag 60, one would simply grab the loose ends 22 of the flexible framing rods (20 & 30) (i.e., the ends 22 not in the interior pocket 62) and begin pulling the ends 22 from the storage bag 60 until the fast-erecting portable structure is completely out of the storage bag 60. One of the two flexible framing rods (20 & 30) is then released (so that the user is holding only one of the two flexible framing rods (20 & 30). Once the user is holding only one of the two flexible framing rods (20 & 30), the fast-erecting portable structure will open on its own. The fast-erecting portable structure can then be placed in a desired location. The four ends 22 of the flexible framing rods (20 & 30) rest on the surface of the desired location forming a base 70. The fast-erecting portable structure allows the structure to be immediately erected from the coiled position in the storage bag 60 into the structure shown in FIGS. 1A and 1B without any intermediate steps or the addition or removal of any parts. The method for the sixpaneled embodiment shown in FIGS. 1C and 1D and other embodiments disclosed herein follow substantially the same steps.

Figure 7:
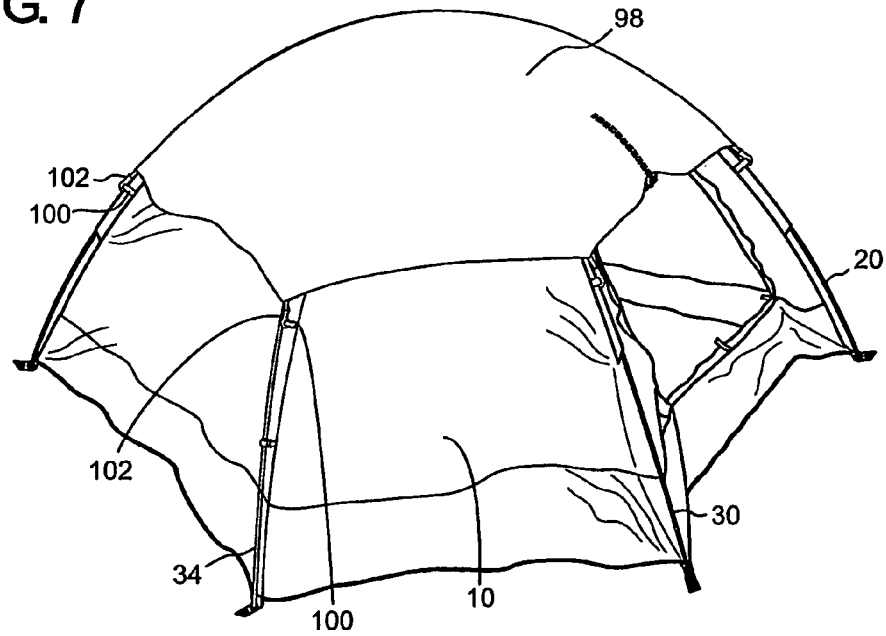
FIG. 7 illustrates a preferred embodiment of the six-panel fast-erecting portable structure with an optional fly.
Figure 7A:
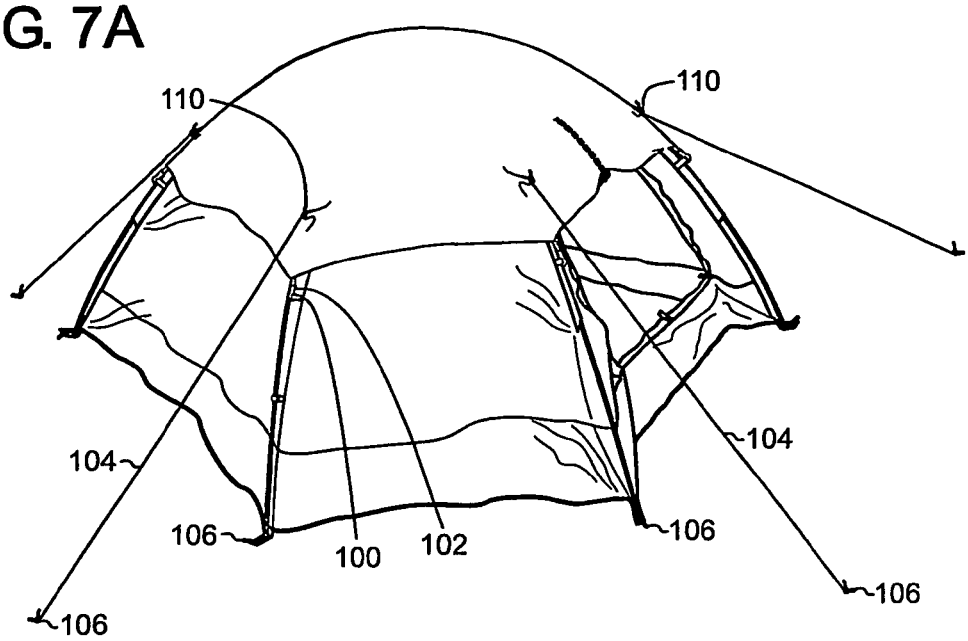
FIG. 7A illustrates the preferred embodiment of the six-panel fast-erecting portable structure with an optional fly and optional guy and stake assembly.
Figure 7B:
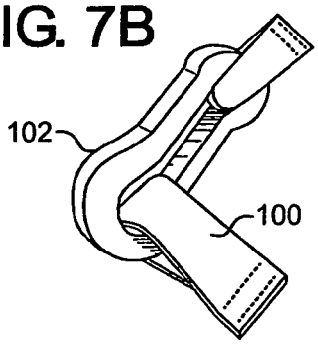
FIG. 7B illustrates and embodiment of a fabric loop 100 and a fly hook 102.
Figure 7C:
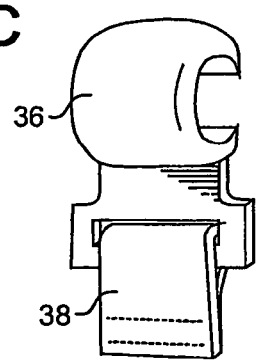
FIG. 7C illustrates and embodiment of a framing rod hook 36 and a fabric loop 38.
Figure 8:
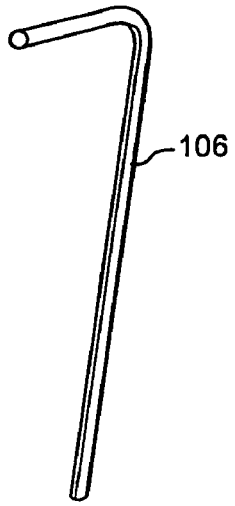
FIG. 8 illustrates a stake 106.
Figure 9:
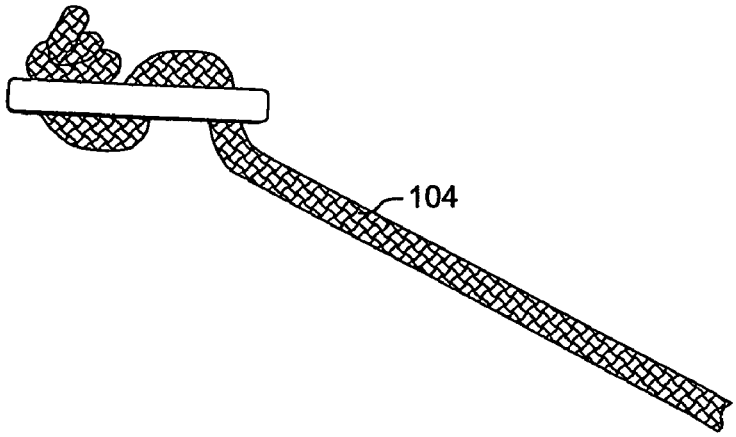
FIG. 9 illustrates a preferred guy cinch.

As shown in FIG. 7, the fast-erecting tent can utilize an optional fly 98. It is preferred that the fly 98 be made from UV resistant waterproof polyester, but many materials can be used. It is also preferred that the fly 98 have a snug fit on top of the fast-erecting tent. This can be accomplished by sewing elastic fabric loops 100 into the flexibly skin and sewing fly hooks 102 into the edge of the fly 98 at corresponding locations as shown in FIG. 7. Doing so, can keep the fly 98 snugged tight against the flexible framing rods (20, 30, and/or 34) of the fast-erecting tent, which helps increase the stability of the fast-erecting tent.

The optional use of guys 104 and stakes 106 can further increase the stability of the fast-erecting tent. If desired, stakes 106 can be added through a second grommet 108 located in each of the flaps 12. Additionally, guys 104 can be tied to fabric guy loops 110 sewn into the fly and to a stake 106 in the ground. The guys can be tightened to further stabilize the fast-erecting tent as is customarily done in the field.

Figure 19:
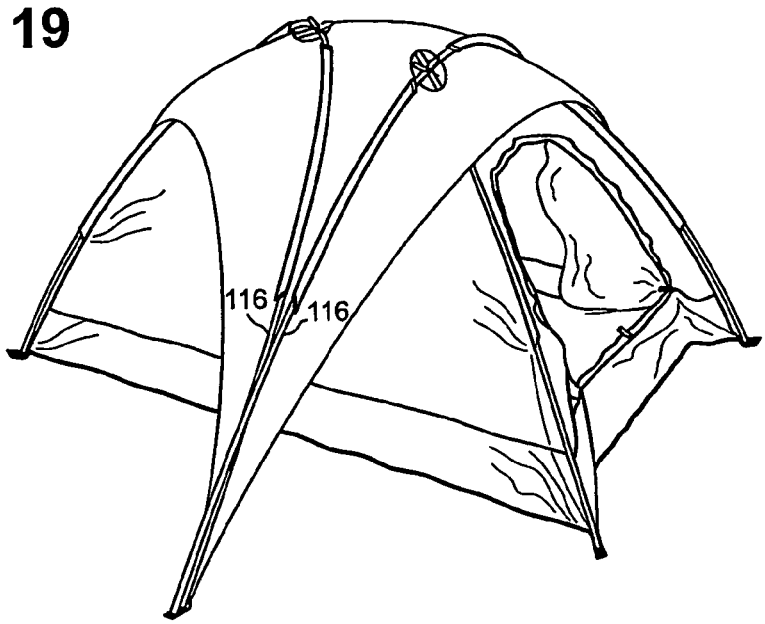
FIGS. 19 and 19A illustrate an additional embodiment of a two framing rod configuration tent with and an optional fly, wherein the optional fly has its own fly framing rods.
Figure 19A:
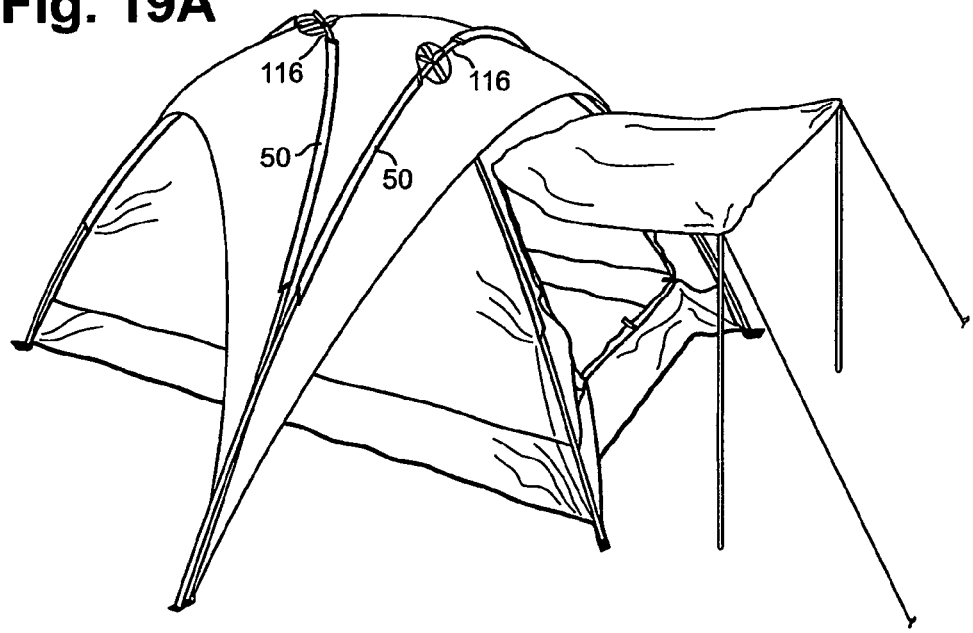

In another embodiment, the fly 98 can also utilize flexible framing rods. For example, as shown in FIGS. 19 and 19A, fly framing rods 116 are non-removably connected the flexible skin 10 at the ends 22 of the fly framing rods 116. The fly framing rods 116 are slidably connected the flexible skin 10 in the middle fly framing rods 116. This can be accomplished through the use of a sleeve 50. Removably connecting the fly framing rods 116 in the manner previously disclosed herein could also be employed. Openings in the flexible skin of the fly can allow the fly framing rods 116 to be connected to the flexible framing rods of the tent.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A fast-erecting portable structure comprising:

a first flexible framing rod formed substantially into an inverted u-shape with an apex, the first flexible framing rod having two ends and a middle, a second flexible framing rod formed substantially into an inverted u-shape with an apex, the second flexible framing rod having two ends and a middle, and wherein the second flexible framing rod crosses the first flexible framing rod near the apexes of the inverted u-shapes, a flexible skin, the flexible skin slidably connected to the middle of the first flexible framing rod, slidably connected to the middle of the second flexible framing rod, non-removably connected to the two ends of the first flexible framing rod, and non-removably connected to the two ends of second flexible framing rod, and wherein the two ends of the first flexible framing rod and the two ends of the second flexible framing rod act as a base of the fast-erected portable structure, and wherein the flexible skin retained within the first and second flexible framing rods and can be coiled together in a stowed position.

2. The fast-erecting portable structure of claim 1 wherein the first and second flexible framing rods are slidably connected to the flexible skin by sleeves.

3. The fast-erecting portable structure of claim 2 wherein the sleeves are made of substantially the same material as the flexible skin of the tent.

4. The fast-erecting portable structure of claim 2 wherein the first and second flexible framing rods are slidably connected to the flexible skin of the tent with the sleeves wherein the sleeves are sewn into the flexible skin along substantially the length of the sleeves.

5. The fast-erecting portable structure of claim 2 wherein the first and second flexible framing rods are slidably connected to the flexible skin of the tent with the sleeves wherein the sleeves are intermittent sleeves sewn into the flexible skin.

6. The fast-erecting portable structure of claim 1 further comprising a fly and a fly framing rod, the fly framing rod having two ends and a middle, the fly non-removably connected to the two ends of the fly framing rod and the fly removably connected to the portable structure.

7. The fast-erecting portable structure of claim 1 further comprising a third flexible framing rod formed substantially into an inverted u-shape with an apex, the third flexible framing rod having two ends and a middle, and wherein the third flexible framing rod crosses the first flexible framing rod and the second flexible framing rod near the apexes of the inverted u-shape of the first and second flexible framing rods, and wherein the flexible skin is removably connected to the middle of the third flexible framing rod and non-removably connected to the two ends of the third flexible framing rod.

8. The fast-erecting portable structure of claim 7 further comprising a fourth flexible framing rod formed substantially into an inverted u-shape with an apex, the fourth flexible framing rod having two ends and a middle, and wherein the fourth flexible framing rod crosses the first flexible framing rod, the second flexible framing rod, and the third flexible framing rod near the apexes of the inverted u-shape of the first, second, and third flexible framing rods, and wherein the flexible skin is removably connected to the middle of the fourth flexible framing rod and non-removably connected to the two ends of the fourth flexible framing rod.

9. The fast-erecting portable structure of claim 8 further comprising a fly and a fly framing rod, the fly framing rod having two ends and a middle, the fly non-removably connected to the two ends of the fly framing rod and the fly removably connected to the portable structure.

10. The fast-erecting portable structure of claim 7 wherein the third flexible framing rod is removably connected to the flexible skin by a plurality of framing rod hooks, the framing rod hooks being non-removably connected to the flexible skin.

11. The fast-erecting portable structure of claim 7 wherein the flexible framing rods are constructed from material selected from the group consisting of steel, spring wire, plastic rod, fiberglass and structural polymer material.

12. The fast-erecting portable structure of claim 7 wherein the flexible framing rods move independently of each other.

13. The fast-erecting portable structure of claim 7 wherein the flexible skin comprises material selected from the group consisting of nylon, polyester, and cotton.

14. The fast-erecting portable structure of claim 7 wherein the flexible skin is connected to at least one flexible framing rod near the intersection of the framing rods by a flexible tie.

15. The fast-erecting portable structure of claim 1 further comprising a third flexible framing rod formed substantially into an inverted u-shape with an apex, the third flexible framing rod having two ends and a middle, and wherein the third flexible framing rod crosses the first flexible framing rod and the second flexible framing rod at a location offset from where the first flexible framing rod and the second flexible framing rod cross each other, and wherein the flexible skin is removably connected to the middle of the third flexible framing rod and non-removably connected to the two ends of the third flexible framing rod.

16. The fast-erecting portable structure of claim 15 further comprising a fourth flexible framing rod formed substantially into an inverted u-shape with an apex, the fourth flexible framing rod having two ends and a middle, and wherein the fourth flexible framing rod crosses the first flexible framing rod and the second flexible framing rod and third flexible framing rod at a location offset from where the first flexible framing rod, the second flexible framing rod, and third flexible framing rod cross each other, and wherein the flexible skin is removably connected to the middle of the fourth flexible framing rod and non-removably connected to the two ends of the fourth flexible framing rod.

17. A storage bag for storing a fast-erecting portable structure having flexible rods, the storage bag comprising, a front sheet having a front sheet perimeter, a front sheet inside face, a front sheet outside face, an opening flap, and an opening flap perimeter, wherein there is a distance between the opening flap perimeter and the front sheet perimeter that is at least one inch, a back sheet having a back sheet perimeter, a back sheet inside face, a back sheet outside face, and a first pocket, wherein the first pocket is connected to the back sheet inside face near the back sheet perimeter and the front sheet perimeter is connected to the back sheet perimeter, wherein the first pocket has a first opening being oriented to receive the first ends of the flexible rods and wherein the front sheet has a second pocket comprising a second opening being oriented to receive second ends of the flexible rods.

18. The storage bag of claim 17 further comprising a spacer having a first edge and a second edge, wherein the first edge of the spacer is connected to the front sheet perimeter and the second edge of the spacer is connected to the back sheet perimeter.

19. The storage bag of claim 18 wherein the second pocket connected to the inside face of the front sheet near the perimeter.

20. The storage bag of claim 19 wherein the first opening and the second opening face in opposite directions.

21. The storage bag of claim 17 further comprising a zipper connected to the front sheet along the opening flap perimeter.

22. The storage bag of claim 17 wherein the storage bag is in the shape of a circular disk.

23. The storage bag of claim 17 wherein the storage bag is in the shape of an elongated circular disk.

24. A method of stowing a fast-erecting portable structure comprising the steps of:

obtaining a fast-erecting tent having a flexible skin, a first flexible framing rod having two ends and a middle, a second flexible framing rod having two ends and a middle, wherein the flexible skin is slidably connected to the middle of the first flexible framing rod, slidably connected to the middle of the second flexible framing rod, non-removably connected to the two ends of the first flexible framing rods, and non-removably connected to the two ends of the second flexible framing rod, and wherein when the fast-erecting portable structure is released, the first flexible framing rod forms substantially into an inverted u-shape with an apex, and the second flexible framing rod forms substantially into an inverted u-shape with an apex, and wherein the second flexible framing rod crosses the first flexible framing rod near the apexes of the inverted u-shapes, and the flexible skin, supported by the first flexible framing rod and the second flexible framing rod, forms a dome shape, obtaining a storage bag comprising a front sheet having a front sheet perimeter, a first inside face, a first outside face, and an opening flap, wherein the opening flap has an opening flap wherein there is a distance between the opening flap perimeter and the front sheet perimeter that is at least one inch, a back sheet having a back sheet perimeter, a second inside face, a second outside face, and a first pocket connected near the back sheet perimeter, wherein the front sheet perimeter is connected to the back sheet perimeter, rotating the first framing rod relative to the second framing rod so that the first framing rod is roughly parallel to the second framing rod, inserting either ends of the first framing rod and the second framing rod into the first pocket, incrementally coiling the first framing rod and the second framing rod into the storage bag, stuffing the flexible skin into the storage bag, and closing the storage bag.

25. A method of stowing a fast-erecting portable structure comprising the steps of:

obtaining a fast-erecting tent having a flexible skin, a first flexible framing rod having two ends and a middle, a second flexible framing rod having two ends and a middle, wherein the flexible skin is slidably connected to the middle of the first flexible framing rod, slidably connected to the middle of the second flexible framing rod, non-removably connected to the two ends of the first flexible framing rod, and non-removably connected to the two ends of second flexible framing rod, a third flexible framing rod having two ends and a middle, wherein the flexible skin is removably connected to the middle of the third flexible framing rod and non-removably connected to the two ends of third flexible framing rod and wherein when the fast-erecting portable structure is released, the first flexible framing rod forms substantially into an inverted u-shape with an apex, the second flexible framing rod forms substantially into an inverted u-shape with an apex, and the third flexible framing rod forms substantially into an inverted u-shape with an apex, and wherein the first, second and third flexible framing rods cross each other near the apexes of the inverted u-shapes, and the flexible skin, supported by the first, second and third flexible framing rods forms a dome shape, obtaining a storage bag comprising a front sheet having a front sheet perimeter, a first inside face, a first outside face, and an opening flap, wherein the opening flap has an opening flap wherein there is a distance between the opening flap perimeter and the front sheet perimeter that is at least one inch, a back sheet having a back sheet perimeter, a second inside face, a second outside face, and a first pocket connected near the back sheet perimeter, wherein the front sheet perimeter is connected to the back sheet perimeter, rotating the first framing rod relative to the second framing rod so that the first framing rod is roughly parallel to the second framing rod, rotating the third flexible framing rod relative to the first and second framing rods so that the third framing rod is roughly parallel to the first and second framing rods, inserting either ends of the first framing rod, the second framing rod, and the third framing rod into the first pocket, incrementally coiling the first framing rod, the second framing rod, and the third framing rod, into the storage bag, stuffing the flexible skin into the storage bag, and closing the storage bag.

26. A fast-erecting portable structure system comprising:

a flexible skin, a first flexible framing rod having two ends and a middle, a second flexible framing rod having two ends and a middle, wherein the flexible skin is slidably connected to the middle of the first flexible framing rod, slidably connected to the middle of the second flexible framing rod, non-removably connected to the two ends of the first flexible framing rods, and non-removably connected to the two ends of second flexible framing rod, and wherein when the fast-erecting portable structure is released, the first flexible framing rod forms substantially into an inverted u-shape with an apex, and the second flexible framing rod forms substantially into an inverted u-shape with an apex, and wherein the second flexible framing rod crosses the first flexible framing rod near the apexes of the inverted u-shapes and the flexible skin, supported by the first flexible framing rod and the second flexible framing rod, forms a dome shape, where the flexible skin is retained within the first and second flexible framing rods in a stowed position and a storage bag having an interior pocket, wherein the first flexible framing rod, the second flexible framing rod and the flexible skin can be coiled and stowed inside the storage bag and the ends of the flexible framing rods are oriented to be received in the interior pocket.

27. A fast-erecting portable structure system comprising:

a flexible skin, a first flexible framing rod having two ends and a middle, a second flexible framing rod having two ends and a middle, and a third flexible framing rod having two ends and a middle, wherein the flexible skin is slidably connected to the middle of the first flexible framing rod, slidably connected to the middle of the second flexible framing rod, removably connected to the middle of the third flexible framing rod, non-removably connected to the two ends of the first flexible framing rods, non-removably connected to the two ends of second flexible framing rod, and non-removably connected to the two ends of the third flexible framing rod, and wherein when the fast-erecting portable structure is released, the first flexible framing rod forms substantially into an inverted u-shape with an apex, the second flexible framing rod forms substantially into an inverted u-shape with an apex, and the third flexible framing rod forms substantially into an inverted u-shape with an apex, and wherein the second flexible framing rod crosses the first flexible framing rod and the third flexible framing rod near the apexes of the inverted u-shape and the flexible skin, supported by the first flexible framing rod, the second flexible framing rod and the third flexible framing rod, forms a dome shape wherein the flexible skin is retained within the first and second framing rods and can be coiled together in a stowed position, and a storage bag having an interior pocket, wherein the first flexible framing rod, the second flexible framing rod, the third flexible framing rod and the flexible skin can be coiled and stowed inside the storage bag and the ends of the ends of the flexible framing rods are oriented to be received in the interior pocket.

28. A fast-erecting portable structure comprising:

a first flexible framing rod formed substantially into an inverted u-shape with an apex, the first flexible framing rod having two ends and a middle, a second flexible framing rod formed substantially into an inverted u-shape with an apex, the second flexible framing rod having two ends and a middle, and wherein the second flexible framing rod crosses the first flexible framing rod near the apexes of the inverted u-shapes, a non-divisible flexible skin, the non-divisible flexible skin slidably connected to the middle of the first flexible framing rod, slidably connected to the middle of the second flexible framing rod, non-removably connected to the two ends of the first flexible framing rod, and non-removably connected to the two ends of second flexible framing rod, and wherein the two ends of the first flexible framing rod and the two ends of the second flexible framing rod act as a base of the fast-erecting portable structure and wherein the flexible skin retained within the first and second flexible framing rods an can be coiled together in a stowed position.

29. A fast-erecting portable structure comprising:

a first flexible framing rod formed substantially into an inverted u-shape with an apex, the first flexible framing rod having two ends and a middle, the first flexible framing rod being non-jointed, a second flexible framing rod formed substantially into an inverted u-shape with an apex, the second flexible framing rod having two ends and a middle, and wherein the second flexible framing rod crosses the first flexible framing rod near the apexes of the inverted u-shapes of the first and second flexible framing rods, the second flexible framing rod being non-jointed, a flexible skin, the flexible skin slidably connected to the middle of the first flexible framing rod, slidably connected to the middle of the second flexible framing rod, non-removably connected to the two ends of the first flexible framing rods, and non-removably connected to the two ends of second flexible framing rod, and wherein the two ends of the first flexible framing rod and the two ends of the second flexible framing rod act as a base of the fast-erecting portable structure wherein the flexible skin retained within the first and second flexible framing rods can be coiled together in a stowed position.

* * * * *